US009115904B2

(12) United States Patent
Bringe et al.

(10) Patent No.: US 9,115,904 B2
(45) Date of Patent: Aug. 25, 2015

(54) HOME APPLIANCE HAVING A HIDEAWAY LABEL PLATE

(75) Inventors: William Bringe, Powell, TN (US); Charlie Hanna, Knoxville, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 137 days.

(21) Appl. No.: 13/475,096

(22) Filed: May 18, 2012

(65) Prior Publication Data

US 2013/0307385 A1 Nov. 21, 2013

(51) Int. Cl.
*F24C 15/18* (2006.01)

(52) U.S. Cl.
CPC ..... *F24C 15/18* (2013.01)

(58) Field of Classification Search
CPC ..... A47B 17/04; A47B 81/00; A47B 96/00; G09F 7/00; G09F 7/22; G09F 7/20; G09F 11/23; F24C 15/18
USPC ..... 312/204, 234, 234.1, 234.3, 234.5, 311, 312/408, 410, 294, 305, 282; 40/492, 40/606.15, 606.08, 611.02, 649, 653, 40/654.01; 126/22, 42, 194, 214 D, 273 R; 219/391; 116/215, 306, 309, 315
See application file for complete search history.

(56) References Cited

U.S. PATENT DOCUMENTS

| | | | | | |
|---|---|---|---|---|---|
| 434,855 | A * | 8/1890 | Worsley | 40/312 |
| 932,008 | A * | 8/1909 | Fate | 40/492 |
| 1,507,786 | A * | 9/1924 | Monigan | 40/492 |
| 1,592,241 | A * | 7/1926 | Welday | 40/492 |
| 2,281,018 | A * | 4/1942 | Barnsteiner et al. | 126/194 |
| 2,477,571 | A * | 8/1949 | Billman et al. | 116/215 |
| 2,605,153 | A * | 7/1952 | Lietz | 108/93 |
| 2,617,381 | A * | 11/1952 | Insul | 116/215 |
| 2,692,813 | A * | 10/1954 | Toronto | 312/408 |
| 2,798,320 | A * | 7/1957 | Montalto | 40/492 |
| 4,021,968 | A * | 5/1977 | Kendall | 49/386 |
| 6,053,585 | A * | 4/2000 | Osen | 312/204 |
| 6,171,173 | B1 * | 1/2001 | Alcala et al. | 446/479 |
| 6,347,232 | B1 * | 2/2002 | de Casillas | 455/550.1 |
| 6,719,383 | B2 | 4/2004 | Elick et al. | |
| 7,220,945 | B1 * | 5/2007 | Wang | 219/392 |
| 7,331,134 | B2 | 2/2008 | Oross et al. | |
| 7,336,505 | B2 | 2/2008 | Campini et al. | |
| 7,389,599 | B2 | 6/2008 | Hishinuma et al. | |
| 7,755,004 | B2 * | 7/2010 | Collene et al. | 219/391 |
| 2004/0187373 | A1 | 9/2004 | Zappacosta et al. | |
| 2006/0283956 | A1 | 12/2006 | Conzola et al. | |
| 2007/0103887 | A1 * | 5/2007 | Bleier et al. | 362/92 |
| 2011/0271984 | A1 * | 11/2011 | Ireland et al. | 134/18 |

FOREIGN PATENT DOCUMENTS

| | | | |
|---|---|---|---|
| DE | 3404256 | * | 8/1985 |

OTHER PUBLICATIONS

Dell Inc., Dell 2209WA Flat Panel Monitor User's Guide, http://support.dell.com/support/edocs/monitors/2209WA/en/ug/about.htm, 2011.

* cited by examiner

*Primary Examiner* — James O Hansen
(74) *Attorney, Agent, or Firm* — James E. Howard; Andre Pallapies

(57) ABSTRACT

A home appliance includes a housing having a cavity accessible by an opening formed in a sidewall of the housing, a door movable for accessing or closing the opening of the housing, and a deployable rating label plate having a label surface, the deployable rating label plate being movable between a first position in which the label surface of the rating label plate is hidden from view by the housing and a second position in which the label surface of the rating label is exposed and visible to a user.

71 Claims, 20 Drawing Sheets

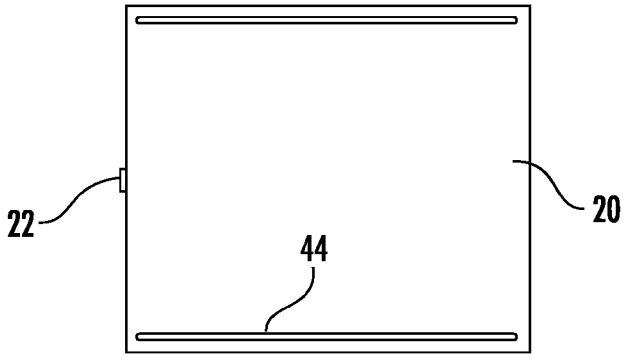
FIG. 10A
FIG. 10B
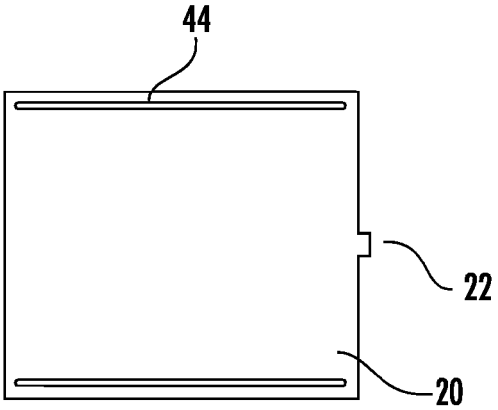
FIG. 10C
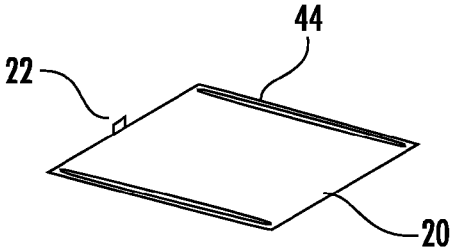
FIG. 10D

HOME APPLIANCE HAVING A HIDEAWAY LABEL PLATE

FIELD OF THE INVENTION

The present invention is directed to an appliance including a hideaway label plate, and more particularly, to an appliance including a pivotally-deployable hideaway label plate.

BACKGROUND OF THE INVENTION

Many appliances may be mandated by various Standard, Agency, Legal and Safety industries to have one or more rating labels semi-permanently or permanently attached to the appliance that provide a variety of information to a user, installer, servicer, and/or inspector. For example, one or more rating labels commonly may be required to provide a variety of electrical information or ratings; 'WARNING' labels to users, installers, and/or repair technicians; installation instructions; manufacturer information, address, contact information, etc.; product, catalog, model, and assembly factory information; cross-reference markings to other compatible appliances; etc., among other things. The various Standard, Agency, Legal and Safety industries commonly provide strict requirements or guidelines for the rating labels themselves, such as the material of the rating labels, the position, location, and accessibility or visibility of the rating labels, among other things.

For example, a household cooking appliance commonly is mandated by various Standard, Agency, Legal and Safety industries to have one or more rating labels semi-permanently or permanently attached to the appliance that provide a variety of information to a user, installer, servicer, and/or inspector. For example, one or more rating labels commonly may be required to provide a variety of electrical information or ratings; 'WARNING' labels to users, installers, and/or repair technicians (e.g., instructions for reducing risk of ignition, spacing requirements, tipping warnings, etc.); installation instructions; manufacturer information, address, contact information, etc.; product, catalog, model, and assembly factory information; cross-reference markings to other compatible appliances; filter removal and cleaning information; venting instructions for ovens, cook tops, ranges, etc., among other things.

The various Standard, Agency, Legal and Safety industries commonly provide strict requirements or guidelines for the rating labels themselves, such as the material of the rating labels, the position, location, and accessibility or visibility of the rating labels, among other things.

For example, semi-permanent and permanent rating labels or plates commonly may be required to withstand a particular temperature or not be adversely affected by temperature or water. The labels or plates commonly may be required to be in an area where the labels will not char, discolor, fade, or otherwise be compromised by cleaning agents and oven self cleaning temperatures. The rating labels or plates, and/or the means (e.g., adhesive) used to adhere the rating labels or plates to the appliance, also commonly must not be adversely affected by water, moisture, or temperature.

Such rating labels may be required to be clear and prominent and "Readily Accessible" in the standards tested and evaluated by Third Party Testing and Listing Agencies. The markings on the rating label commonly must be readily visible after the appliance is installed as intended. That is, the rating labels must be located where the user, installer, servicer, and/or inspector can view the labels after installation of the appliance (e.g., a cooking appliance) and without the use of tools to view the labels. For example, a marking on a label or plate that is not visible without moving the appliance from its mounting installation typically commonly is not acceptable under the standards. On the other hand, a marking that is not visible unless a part on the appliance is moved or removed may be acceptable if the label or plate can be accessed by removing the part of the appliance without the use of tools. For example, a label or plate commonly must be visible either by opening a door or a drawer, lifting the top of the appliance, or removing one more parts that normally are removable by the user without the use of tools.

SUMMARY OF THE INVENTION

The present invention recognizes that marketing, sales, appliance designers such as household appliance designers, home designers, and customers commonly may deem such rating labels and plates to be "unsightly" when they are visible because the labels or plates may take away from the design, look and feel of an expensive custom kitchen. For example, in the case of a household appliance, such as a free standing cooking range, an oven, a cooktop, a refrigerator, a dishwasher, etc., the appliance may have limited room on the front to place the rating labels or plates. Such labels and plates commonly are large and take up a lot of space due to the amount of content/information required to be displayed on the label or plate by the Standard, Agency, Legal and Safety industries. The labels or plates commonly cannot be placed on the sides or rear of the appliance since most installations cover these surfaces and thus the labels would not be visible after installation.

The present invention recognizes that the placement of such rating labels and plates may be further limited by the requirements for the labels or plates for a particular appliance, or type of appliance, to have a temperature limit and restrictions or limitations on the acceptable areas where the labels will not char, discolor, fade, or otherwise be compromised by cleaning agents and oven self cleaning temperatures.

The present invention addresses these problems by providing a rating label or plate that can meet or exceed the standards and requirements of the various Standard, Agency, Legal and Safety industries, can be semi-permanently or permanently attached to the appliance, and can provide a variety of required and additional information to a user, installer, servicer, and/or inspector, while being inconspicuously located to minimize or avoid a negative impact on the design, look and feel of the appliance, and at the same time, being able to be quickly and efficiently accessed and viewed by a user, installer, servicer, and/or inspector.

For example, a first exemplary embodiment of an appliance, such as a domestic household cooking appliance, can include a housing having an opening for accessing an interior of the housing; a door movable for accessing or closing the opening of the housing; and a deployable rating label plate having a label surface, the deployable rating label plate being movable between a first position in which the label surface of the rating label plate is hidden from view by the housing and a second position in which the label surface of the rating label plate is exposed and visible to a user.

Another exemplary embodiment of the invention comprises an appliance, such as a household cooking appliance, including a cavity formed in the housing, wherein the deployable rating label plate is movable between the first position in which the label surface of the rating label plate is disposed within the cavity such that the rating label plate is hidden from view by the housing and the second position in which the label surface of the rating label plate is disposed outside the cavity such that the rating label plate is exposed and visible to the user.

In an embodiment, the cavity can be formed in a front face of an edge of the housing surrounding the opening to the interior of the housing. The front face, or at least a portion of the front face having the cavity, can be covered by a portion of the appliance door when the door is in a closed position on the housing. In this way, the cavity and the stored rating label plate can be concealed from view when the rating label plate is in the stored position and the door of the appliance is closed. In other embodiments, the cavity may not be concealed or covered by the door when the door is closed.

In an embodiment, an appliance can have a rotating (hide-away) rating label plate that easily can be moved between a first (e.g., stored or concealed) position in which the label surface of the rating label plate is hidden from view by the housing or a part of the housing, and a second (e.g., exposed or visible) position in which the label surface of the rating label plate is exposed and visible to a user, installer, servicer, and/or inspector. The rating label plate can be pivotable about a point alongside the housing such that the label faces the opening of the appliance when in a deployed, visible position such that the label is visible even when the appliance is installed adjacent to a wall. In other embodiments, the rating label plate can be stored in and deployable from within an existing gap between the side panel of the appliance and the opening of the appliance, or in a cavity that is specifically designed for the rating label plate.

In other embodiments, the rating label plate can include one or more pull tabs (e.g., fingernail pull tabs) to assist a user with opening or deploying the rating label plate from a stored position. Such a pull tab can be configured to provide one or more additional or alternative functions. For example, the pull tab of the rating label plate can include a stop means for preventing the plate from over-rotating alongside the housing or over-rotating into the cavity in the housing where the rating label plate may not be retrieved or at least not easily retrievable by the user. The pull tab also may have a size and shape that provides a suitable cam surface for contacting an interior surface of the appliance door when the rating label plate is deployed and transferring forces from the door to the rating label plate to guide or urge the rating label plate into the stored position when the door is moved from an open position to a closed position. For example, the force exerted by the user on the door to close the door can be transmitted to the label plate by the interaction of the pull tab with the interior surface of the appliance door to cause the rating label plate to correspondingly or automatically move into the stored position if the rating label plate is in a deployed or partially deployed state when the door is being closed. In other exemplary embodiments, the pull tab can include a friction or wear reducing portion, such as a roller or friction reducing surface. The roller or friction reducing surface may be formed from a material such as metal, Teflon, nylon, etc., and/or have a shape (e.g., curved shape, smooth shape, etc.) that functions as a suitable cam surface for contacting an interior surface of the appliance door such that the rating label plate easily is guided or urged by the door into the stored position when the door is moved from an open position to a closed position, for example, with minimal effort, without causing wear, marking, etc., to the surface of the door or rating label plate, while also minimizing or preventing a locking up of the rating label plate with the door, jamming of the rating label plate, etc. The friction reducing portion can be formed from a material having suitable heat resistant, fire resistant, or fire retardant qualities.

In other embodiments, the rating label plate can include one or more stop means for preventing the plate from over-rotating, or over-translating, out away from the appliance from alongside the housing or out of the cavity of the housing. The label plate and/or the stop means of the label plate also can be configured to assist with biasing the label plate in the stored position when the label plate is rotated to or beyond a predetermined point (e.g., approximately or substantially 45°) about the pivot point. For example, the location of a pivot point of the label plate and/or a mass of the stop means formed on the rating label plate can be selected such that the label plate can provide a "soft close" function such that, once the label plate is moved about the pivot point to or beyond a predetermined point, the weight of the rating label plate (or the weight of the stop means on the rating label plate) causes the rating label plate to continue rotating until the rating label plate arrives at the stored position without further input or force being applied by the user. These features also may reduce or prevent damage or wear resulting from the rating label plate contacting the interior surface of the appliance door, for example, since the rating label plate is stored in a concealed location when the rating label plate is not in use.

In other exemplary embodiments, biasing means (such as one or more springs) may be provided to provide or assist with the movement of the rating label plate from the closed position to the deployed position, or from the deployed position to the closed position. The rating label plate may include one or more features or parts for receiving or engaging an end of a spring coupled at the other end to the housing or another part. The features or parts may be separate parts or integrally formed with the plate and may include, for example, an opening, through-hole, notch, groove, emboss, or the like formed in a surface of the plate, or a projection such as a pin, rod, spindle, or shaft, protuberance, or the like extending away from the plate, for receiving or engaging the spring. In other embodiments, the rating label plate may include one or more detents for receiving a portion of one or more spring cam devices or the like.

The rating label plate can be movable from an entirely stored position to an entirely deployed position, or in increments in between, such as one or more partially deployed positions. The rating label plate can be configured to stop at one or more of the deployed and/or partially deployed positions. For example, the rating label plate can include one or more detents for receiving one or more spring cam devices or the like on the housing or another part for temporarily stopping or suspending the rating label plate at one or more of the deployed and/or partially deployed positions. In other embodiments, an incremental hinge device may be provided for temporarily stopping or suspending the rating label plate at one or more of the deployed and/or partially deployed positions.

The pivot point of the label plate may be above the pivot point of the door to facilitate contact of the pull tab with an interior surface of the door when the door is being closed, and thus, cause the label plate to rotate into the closed position. The location of the pivot point of the label plate may reduce or prevent jamming of the label plate against the door of the appliance. In other embodiments, the rating label plate can include biasing means for biasing the rating label plate into the closed position, such as one or more springs biasing the rating label plate in the closed position.

In another exemplary embodiment, the housing of the appliance can include one or more tabs or guide portions that guide the rating label plate during movement between the stored position and deployed position and/or that stabilize the rating label plate in the stored or deployed position. For example, the housing can include a tab projecting from a surface that is adjacent to the rating label plate such that a portion or edge of the rating label plate is disposed between the tab and a surface of the housing during movement between the stored position and deployed position and/or when the rating label plate is in the stored or deployed position. In other embodiments, the tab or guide can include a projection such as a pin, rod, spindle, follower, raised portion, protuberance, or the like formed on the rating label plate or the housing, respectively, and a corresponding slot, cam surface, emboss, recessed portion, or the like formed on the other of the rating label plate or the housing, respectively.

In other exemplary embodiments, a portion of the tab or guide and/or a portion of the rating label plate can include a friction or wear reducing portion, such as a roller or friction reducing surface. The roller or friction reducing surface may be formed from a material such as metal, Teflon, nylon, etc., and/or have a shape (e.g., curved shape, smooth shape, etc.) such that the rating label plate can be easily and smoothly guided while moving between the stored position and deployed position. The friction reducing portion can be formed from a material having suitable heat resistant, fire resistant, or fire retardant qualities.

A portion of the tab or guide, the housing, and/or a portion of the rating label plate can include a seat or the like to provide a user with a tactile seating of the rating label plate in the stored position. The seat or the like can include one or more resilient portions, flexible portions, corresponding engaging portions, etc. that facilitate the seating or tactile seating of the plate with respect to the tab or guide, the housing, etc.

In an embodiment, the rating label plate can have a circular, oval, half-circle, or quarter-circle shape to facilitate easy rotation and deployment and storage. In other embodiments, the rating label plate can be rectangular, square, or triangular. The rating label plate can be rotatable, pivotable, or linearly translatable or slidable between the stored position and the deployed position. In still other embodiments, the rating label plate can have an irregular or amorphous shape.

In other embodiments, the rating label plate can be formed from a plurality of rating label plates, for example, that fan out from the deployed position. In these exemplary embodiments, the pull tabs may be staggered to permit the user to easily select and grasp any of the pull tabs when the rating label plates are in a stored position. One or more of the rating label plates may have the same size and/or shape or a different size or shape.

In still other embodiments, the rating label plate can be disposed in a vertical position with respect to the appliance such that the rating label plate rotates out and downward from the stored position to the deployed position. However, in other embodiments, the rating label plate can be disposed in a horizontal position with respect to the appliance such that the rating label plate rotates out from the appliance in an approximately or substantially horizontal plane from the stored position to the deployed position. In some embodiments, the rating label plate can be disposed in a vertical position with respect to the appliance such that the rating label plate rotates out and upward from the stored position to the deployed position. One or more biasing means (such as one or more springs or detent/spring cam devices) may be provided to prevent the rating label plate from rotating back into the closed position without being manually held by the user in the deployed/open position.

In still other embodiments, the rating label plate can be disposed in a location that is concealed or hidden by the door and in which access to the rating label plate is obstructed by the door when the door is in the open or closed position, since many cooking appliance doors can be easily and readily removed without tools, thereby complying with the applicable standards for being "readily accessible."

In other exemplary embodiments, the rating label plate can be stored in other parts of the appliance depending on the particular appliance. For example, in a cooking appliance, the rating label plate can be stored at a position alongside an exterior side of the housing, in a location (e.g., a pocket) in a side of the housing, in a location in the housing that is hidden by the door when the door is closed (e.g., a surface surrounding the opening to the cooking chamber, such as a surface alongside, above, or below the opening to the cooking chamber), behind a removable kick panel or access panel, in a side or top surface of a door, drawer, or kick panel of the appliance, in a surface of a control panel of the appliance, in a surface of a backsplash or backsplash/shelf of the appliance, etc., among other locations.

In this manner, the exemplary embodiments of the present invention can provide an appliance, such as a household cooking appliance, having a rotating (hideaway) rating label plate that is "readily accessible" by simply and easily moving the rating label plate with respect to the housing of the appliance between a first (e.g., stored or concealed) position in which the label surface of the rating label plate is hidden from view by the housing or a part of the housing, and a second (e.g., exposed or visible) position in which the label surface of the rating label plate is exposed and visible to a user, installer, servicer, and/or inspector.

Accordingly, the exemplary embodiments can comply with the applicable appliance standards as tested and evaluated by Third Party Testing and Listing Agencies, while minimizing visibility of the labels to a user, which may be desirable to marketing, sales, kitchen/home designers and customers. A rotating plate, such as a rotating stainless steel plate, can be provided that rotates about a pivot point (hides) along side or adjacent to the housing of the appliance, or within a cavity in the housing of the appliance. In other embodiments, the plate can translate or slide alongside or adjacent to the housing of the appliance, or into a cavity in the housing of the appliance.

The exemplary label plate can include the necessary safety/Agency related labels and Markings necessary for installation, service, information, etc. The rating label plate is not limited to rating labels and can be used to easily and conveniently display other types of information, such as suggested cooking temperatures and times, recipes, menus, trouble shooting, wiring diagrams, etc. The rating label plate can include rating labels and other information adhered to the rating label plate. In other embodiments, the labels and other information can be embossed, engraved, or etched on the rating label plate, which may prevent or avoid discoloration, wear, fading, or damage to the label or information, for example, from heat, cleaning solutions, water, etc.

The rotation of the plate can provide for minimum visibility of the labels in instances in which the labels are not needed or when the appliance is in use, while still meeting all applicable external, internal, and customer related requirements.

In the exemplary embodiments, the location of the rating label plate in the exemplary stored or concealed position(s) can provide additional advantages of protecting the label from spillage, cleaning chemicals, and/or wear during normal use, etc.

Moreover, the exemplary location of the rating label plate in the stored or concealed position(s) can provide further advantages such of acting as a heat shield for the side panel of the appliance, or another part of the appliance, or an exterior of the appliance. The rating label plate can direct and/or improve airflow within the appliance, alongside of the appliance, and/or between the appliance and another adjacent appliance or cabinet.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein:

FIGS. 10A-10D are plan views and perspective views respectively of a rating label plate according to an exemplary embodiment of the invention.

DETAILED DESCRIPTION OF THE EXEMPLARY EMBODIMENTS OF THE INVENTION

Figure 1A:
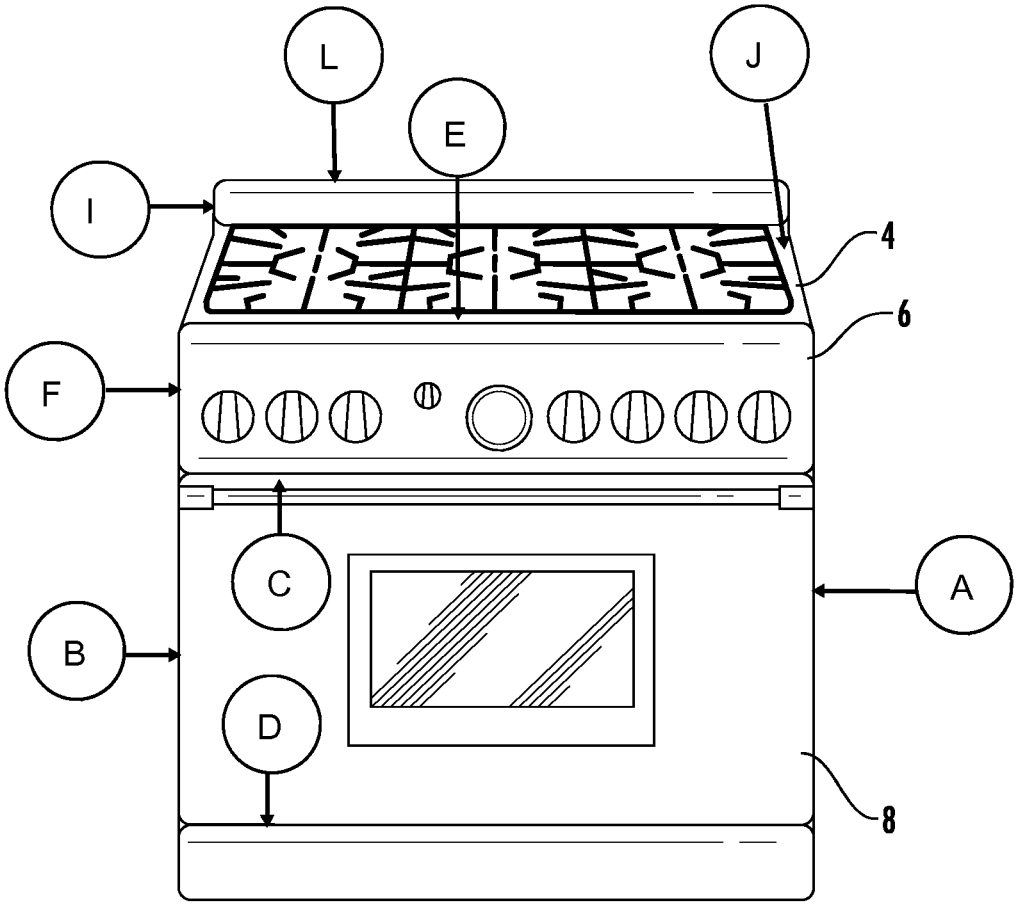
FIG. 1A-1C are front perspective views of exemplary household cooking appliances.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1A-14C illustrate exemplary embodiments of an appliance including a hideaway label plate with reference to examples of household cooking appliances. The exemplary embodiments are described with reference to a household cooking appliance such as, for example, a gas cooking range 2. However, one of ordinary skill in the art will recognize that the appliance having the rating label plate is not limited to the exemplary household cooking appliances described herein, and can include various other appliances that may require or benefit from deployable rating label plates or information plates, such as portable cooking appliances, small or portable kitchen appliances, electronic devices such as printers, copiers, etc., HVAC appliances, lighting fixtures, etc.

Figure 1B:
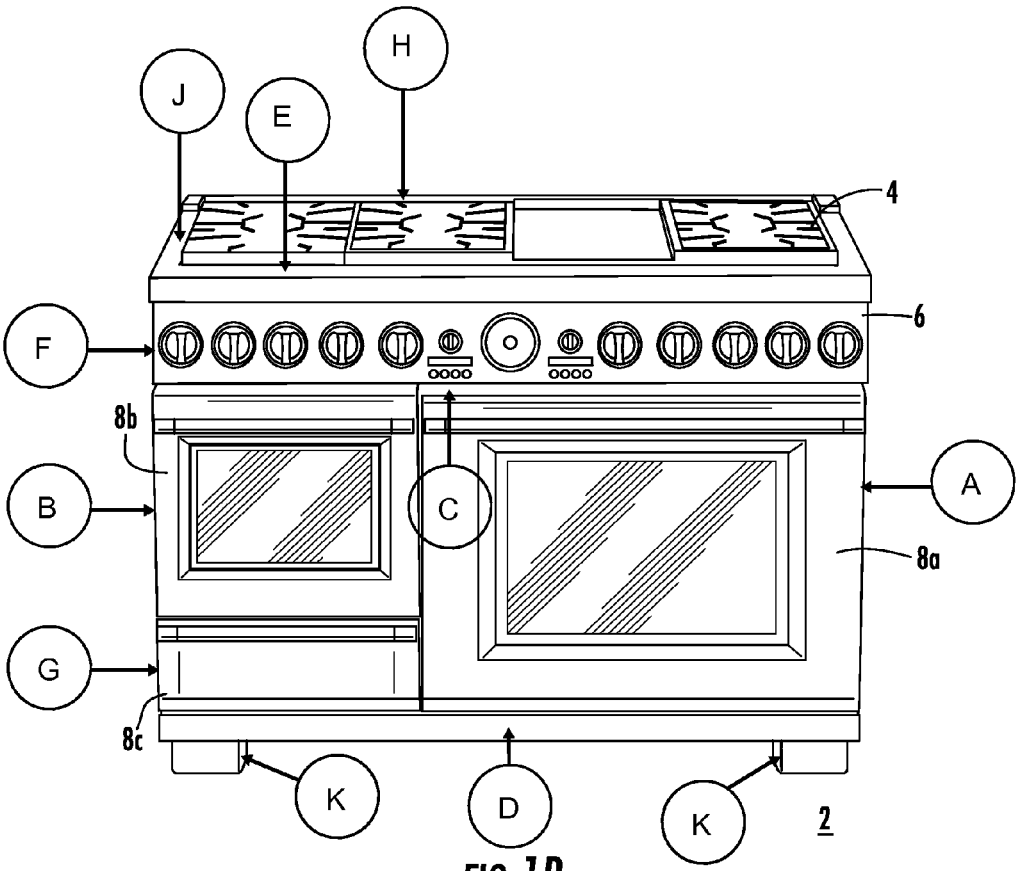
Figure 1C:
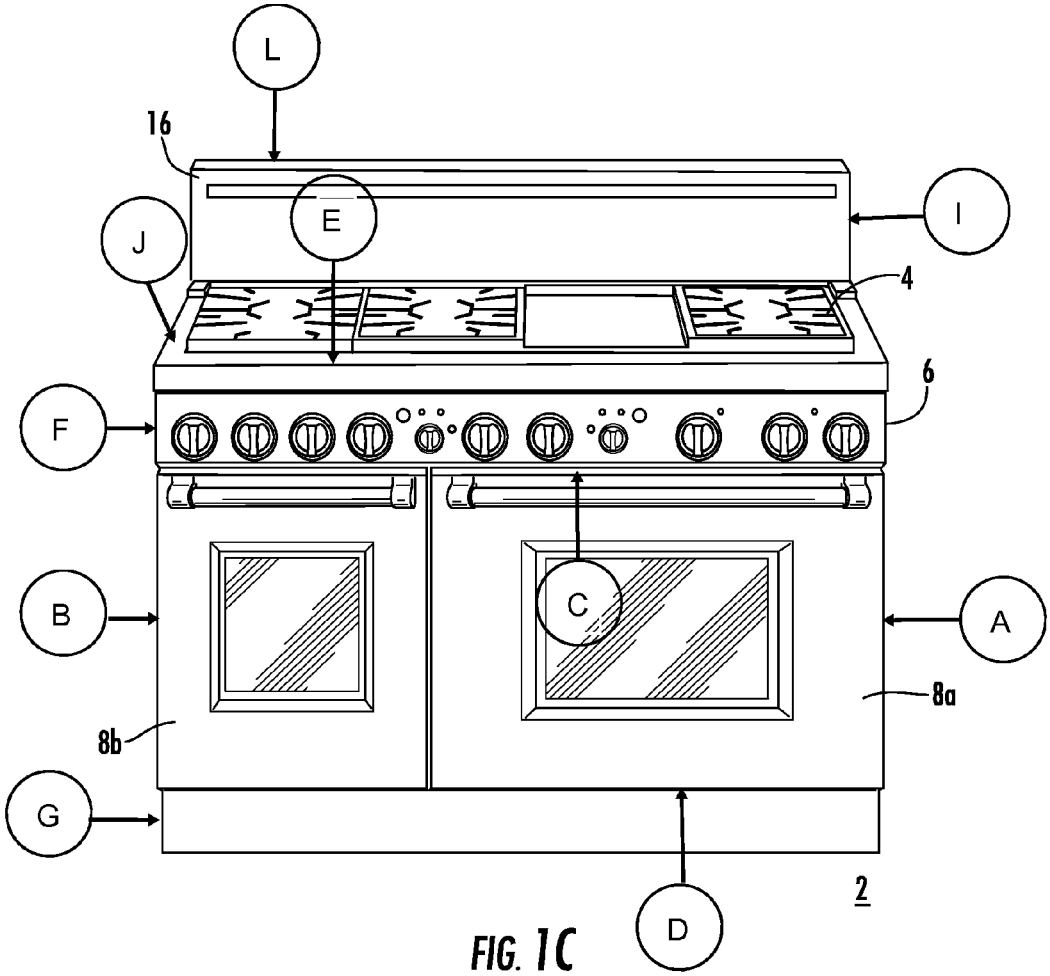

With reference to FIGS. 1A-1C, a household cooking appliance can include, for example, a gas cooking range 2. In other embodiments, the household appliance can include a standalone cook top or the like. In the example cooking appliances illustrated in FIGS. 1A-1C, a plurality of gas burners may be disposed on an upper surface 4 of the cooking appliance. A control panel 6 may be disposed, for example, on a front surface or an upper surface of the cooking appliance. The control panel 6 may include a plurality of control knobs for controlling the individual gas burners. The exemplary appliances 2 may include one or more doors (e.g., oven door 8, 8*a*, steam and convection oven door 8*b*, warming drawer door 8*c*) providing access to an interior of, for example, a cooking chamber, steam cooking chamber, warming drawer, etc. Moreover, the exemplary location of the rating label plate 20 in each of the various embodiments of stored or concealed positions can provide further advantages such of acting as a heat shield for a portion of the appliance, such as the side panel of the appliance, or another part of the appliance, an exterior of the appliance, or another adjacent appliance. The exemplary embodiments of the rating label plate 20 can direct and/or improve airflow within the appliance, alongside of the appliance and/or between the appliance and another adjacent appliance, cabinet, etc.

One of ordinary skill in the art will recognize that various rating label plate arrangements are possible and the exemplary embodiments are not limited to the illustrated arrangements. For example, with reference to FIGS. 1A-1C, one or more rating label plates (described with reference to FIGS. 2A-2G) can be stored in one or more parts or areas of the appliance 2 depending on the particular appliance, such as at one or more of positions A-L, among other positions.

With reference to FIGS. 2A-2G, an exemplary embodiment of an appliance 2 and rating label plate 20 will now be described.

The household appliance can include a front face 10 surrounding an opening 12 in the housing for accessing an interior of the housing, such as a cooking compartment. The household appliance can be, for example, a household cooking appliance such as a stand-alone oven range.

The exemplary appliance includes a rotating (hideaway) rating label plate 20 that easily can be moved between a first (e.g., stored or concealed) position (e.g., FIGS. 2B-2C) in which the label surface of the rating label plate is hidden from view by the housing or a part of the housing, and a second (e.g., exposed or visible) position (e.g., FIGS. 2A and 2D-2G)

in which the label surface of the rating label plate is exposed and visible to a user, installer, servicer, and/or inspector.

In the embodiment of FIGS. 2A-2G, the front face 10 of the housing includes a dedicated cavity 14 formed in the front face 10 surrounding the opening 12 in the housing. The rating label plate 20 includes a label surface 30. The rating label plate 20 is movable between a first position in which the label surface 30 of the rating label plate 20 is hidden from view by the housing (see, e.g., FIGS. 2B-2C) and a second position in which the label surface 30 of the rating label plate 20 is exposed and visible to a user (see, e.g., FIGS. 2A and 2D-2G). One of ordinary skill in the art will recognize that the rating label plate can be deployable between a position along-side an outer surface of the housing and a position inside a cavity 14 of the housing. In other embodiments, the rating label plate 20 can be stored in and deployable from within an existing gap between the side panel of the appliance and the opening 12 of the appliance.

As shown in FIGS. 2A-2G, the rating label plate 20 can include one or more rating labels on the label surface 30 and/or other information semi-permanently or permanently coupled to, or adhered to, the rating label plate 20, for example, with adhesive or the like. In other embodiments, one or more of the labels and/or other information can be embossed, engraved, or etched on the label surface 30 of the rating label plate 20.

In the exemplary embodiment of FIGS. 2A-2G, the cavity 14 can be formed in a front face 10 of the housing surrounding the opening 12 to the interior of the housing. The front face 10, or at least a portion of the front face 10 having the cavity 14, can be covered by a portion of the appliance door 8 when the door is in a closed position on the housing. In this way, the cavity 14 and the stored rating label plate 20 can be concealed from view when the rating label plate 20 is in the stored position and the door 8 of the appliance is closed. In other embodiments, the cavity 14 may not be concealed or covered by the door 8 when the door 8 is closed.

In the exemplary embodiment of FIGS. 2A-2G, the rating label plate 20 can be pivotable about a pivot point 24 with respect to the housing such that the label surface 30 faces the opening 12 of the appliance when in a deployed, visible position such that the label surface 30 is visible even when the appliance is installed adjacent to a wall.

With reference to the exemplary embodiments of FIGS. 2A-2G and 3A-4B, the exemplary rating label plate 20 can include, for example, a straight edge 20*a* that is flush with the opening of the cavity 14 when the rating label plate 20 is in the closed position, and a curved edge 20*b* that facilitates easy rotation of the rating label plate 20 into and out of the cavity 14. The rating label plate 20 can have a quarter-circle shape, half-circle shape, etc. In other embodiments, the rating label plate 20 can be other shapes, such as square, rectangular, triangular, etc., while still being rotatable within the cavity 14, for example, if sufficient clearance is provided/available inside the cavity 14.

The exemplary rating label plate 20 can include one or more pull tabs 22 (e.g., fingernail pull tabs) to assist a user with opening or deploying the rating label plate 20 from a stored position. With reference to the exemplary embodiments in FIGS. 4A-4D, the pull tab 22 can have any suitable shape that permits the user to grasp the pull tab 22 when the rating label plate 20 is in the stored position and move the rating label plate 20 to the deployed position. For example, the pull tab 22 can extend substantially perpendicular to, or at an angle to, the plane of the rating label plate 20. The pull tab 22 can extend from one or both sides of the rating label plate 20. The pull tab 22 can have a substantially planar shape, a curved, shaped, or a plurality of portions having one or more shapes and/or extending in one of more directions. For example, the pull tab 22 can have a first portion 22*a* that extends in a first direction and a second portion 22*b* that extends in a second direction. With reference again to the exemplary embodiment in FIGS. 4A-4D, the second portion 22*b* can be, for example, at an angle of approximately 150 degrees with respect to the first portion 22*a*. One of ordinary skill in the art will recognize that arrangement of these portions is not limited to the exemplary embodiments and the portions can be at other angles with respect to each other.

Figure 2A:
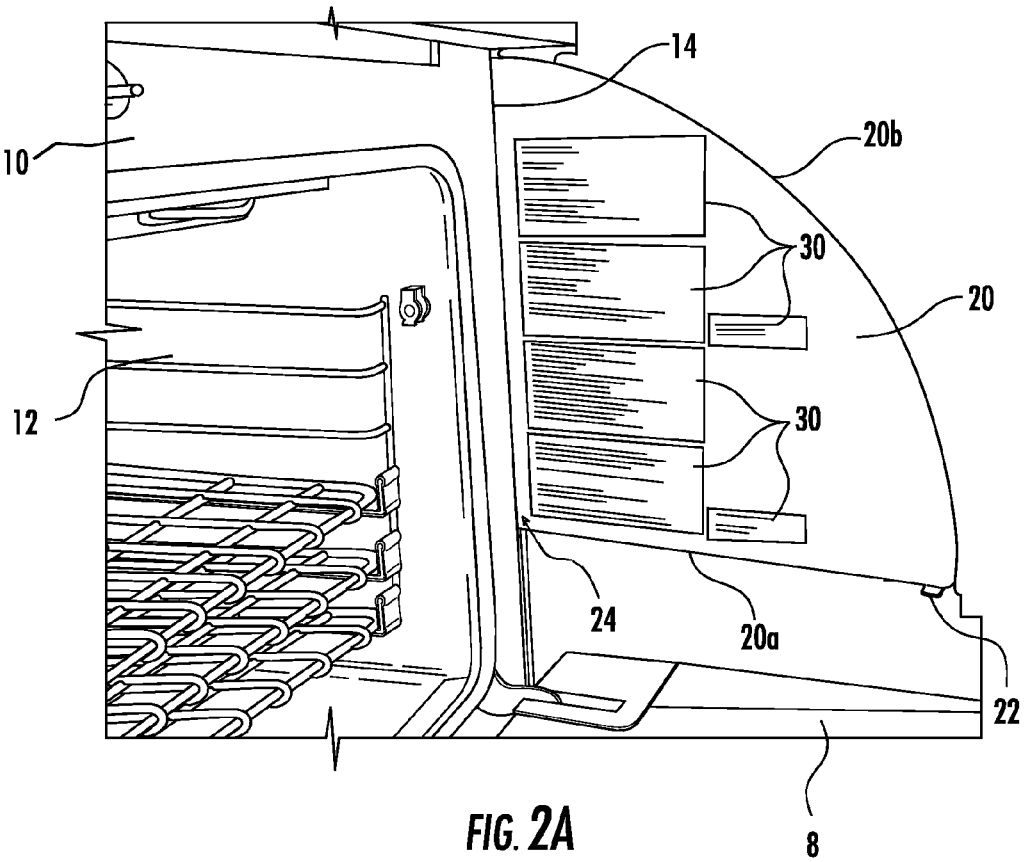
FIGS. 2A-2G are views of a hideaway label plate in various states of deployment from and storage in a cavity of an appliance according to an exemplary embodiment of the invention.
Figure 2B:
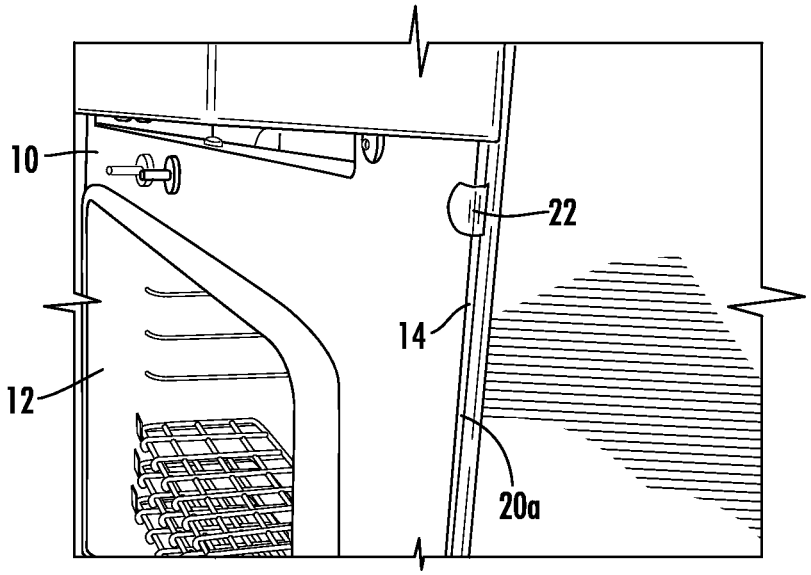
Figure 2C:
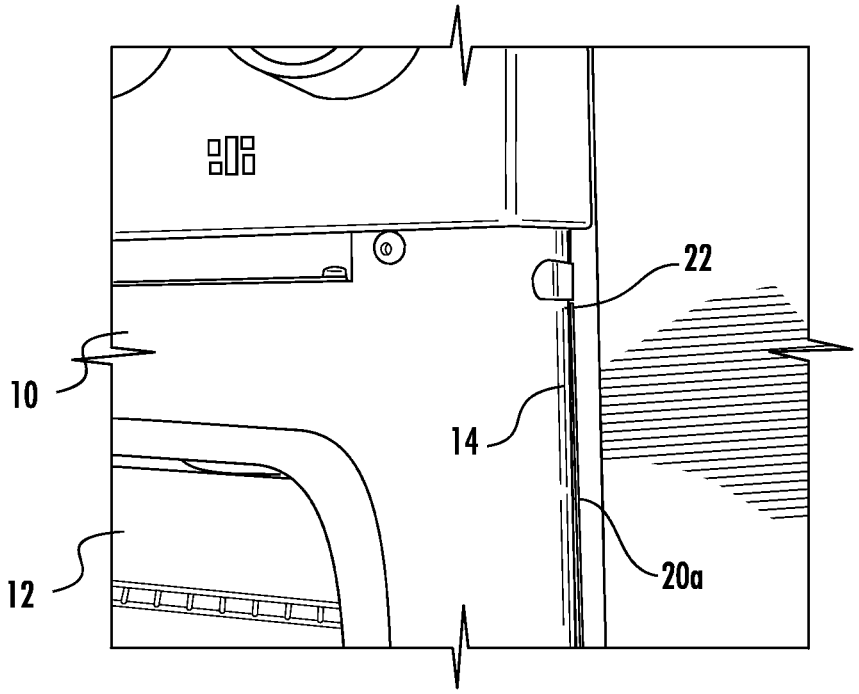
Figure 2D:
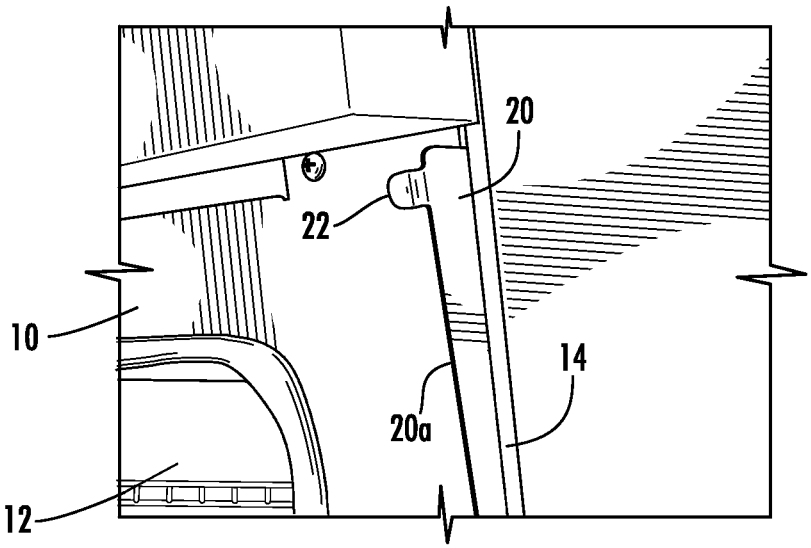
Figure 2E:
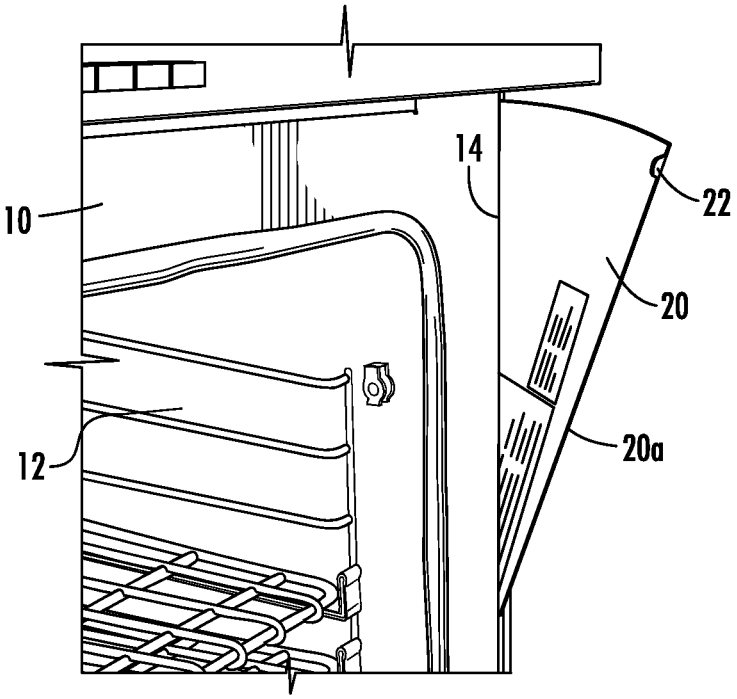
Figure 2F:
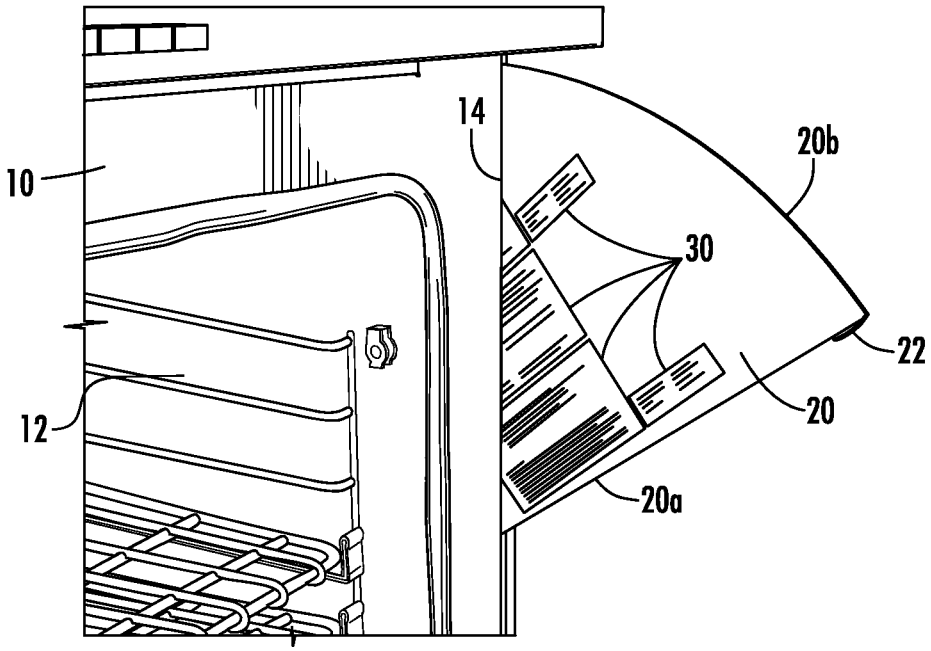
Figure 2G:
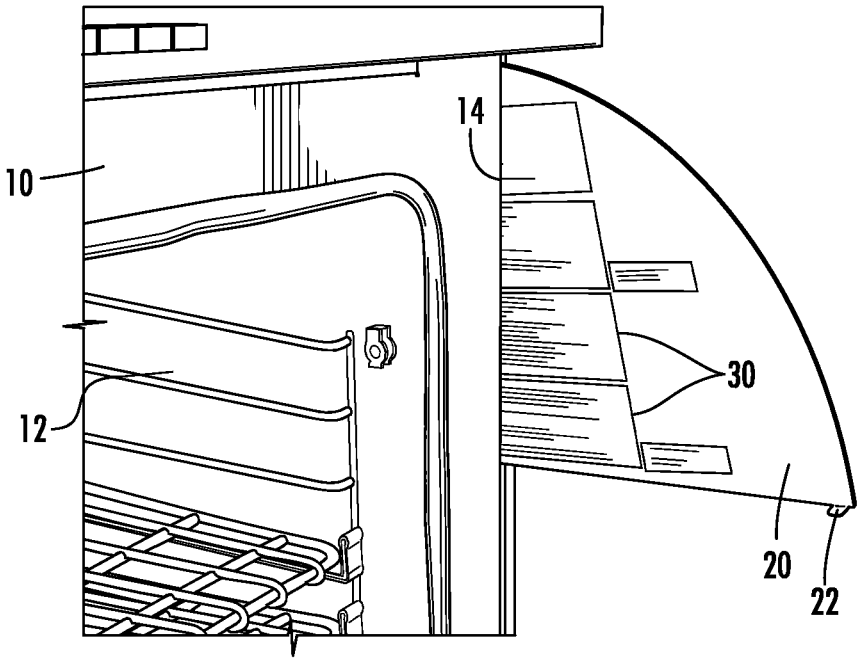
Figure 3A:
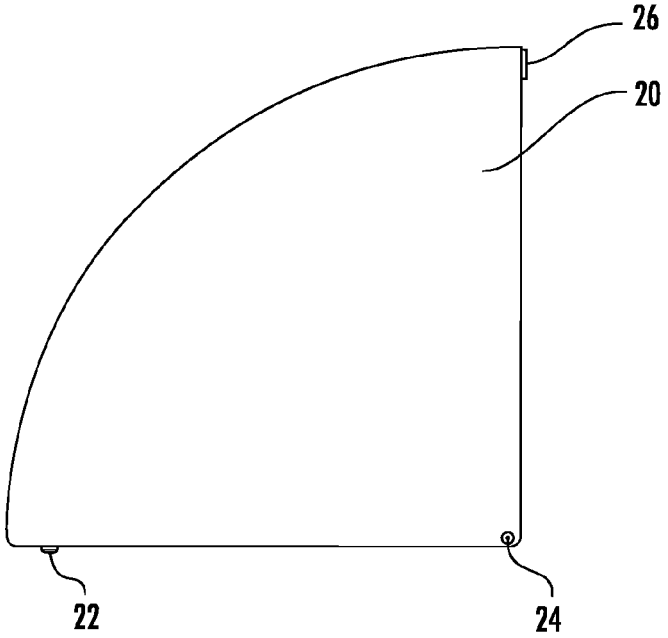
FIGS. 3A-3D are plan, side, and perspective views respectively of a rating label plate according to an exemplary embodiment of the invention.
Figure 3B:
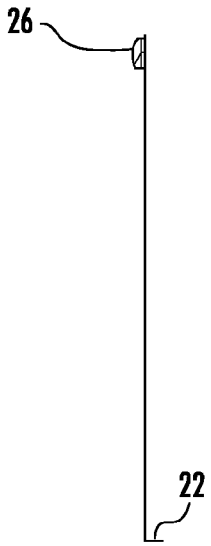
Figure 3C:
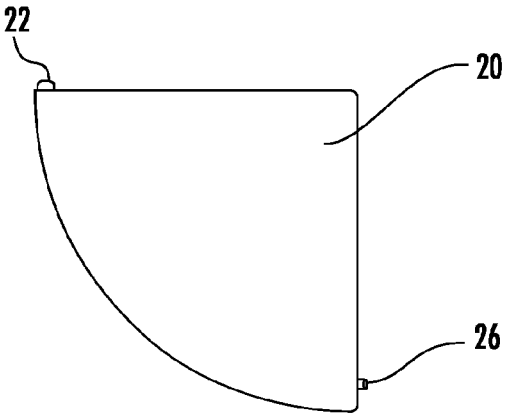
Figure 3D:
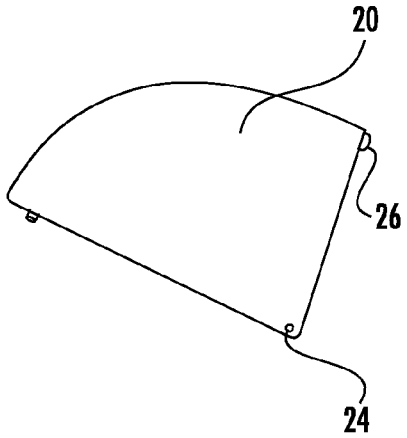
Figure 4A:
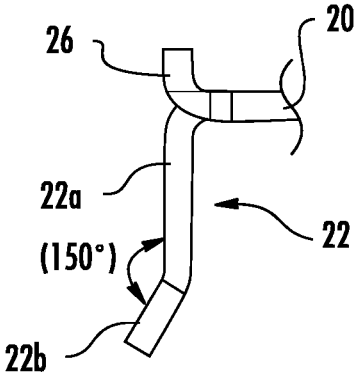
FIGS. 4A-4D are partial side views of a portion of a rating label plate according to an exemplary embodiment of the invention.
Figure 4B:
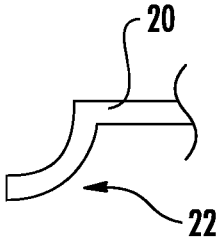
Figure 4C:
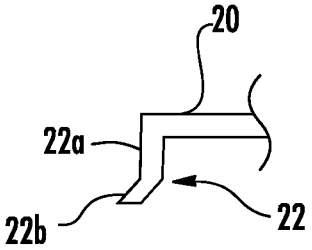
Figure 4D:
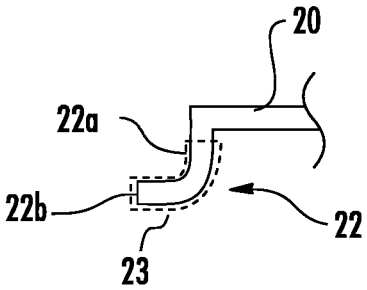
Figure 5A:
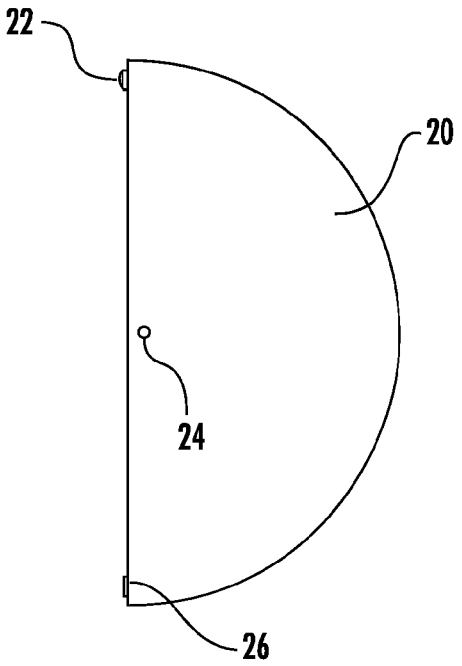
FIGS. 5A-5C are a plan view, side view, and side detail partial view, respectively, of a rating label plate according to an exemplary embodiment of the invention.
Figure 5B:
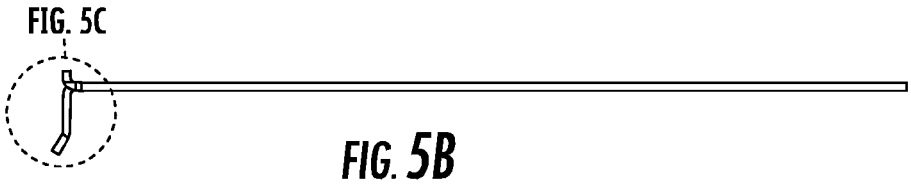
Figure 5C:
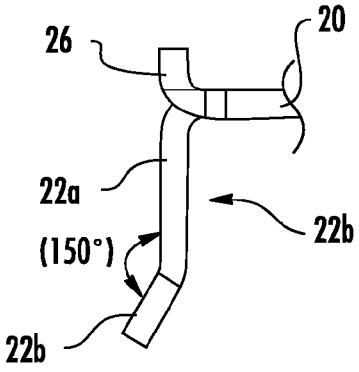
Figure 6A:
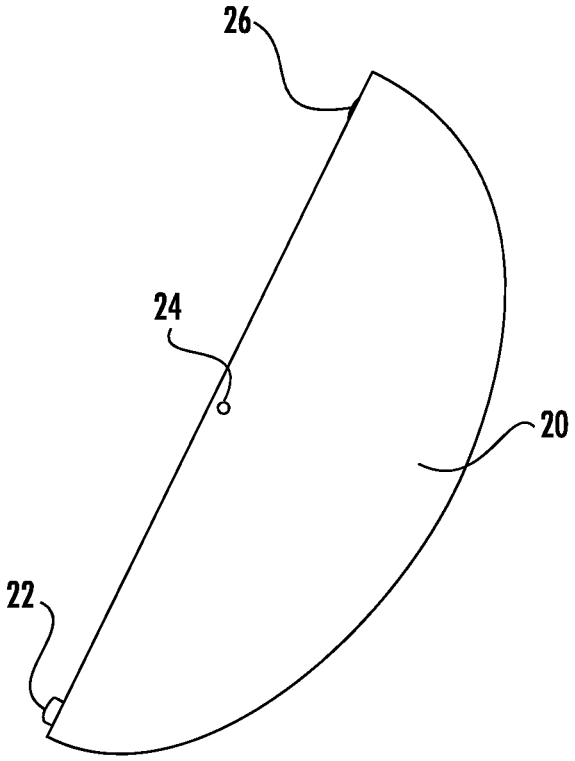
FIGS. 6A and 6B are a perspective view and a plan view respectively of a rating label plate according to an exemplary embodiment of the invention.
Figure 6B:
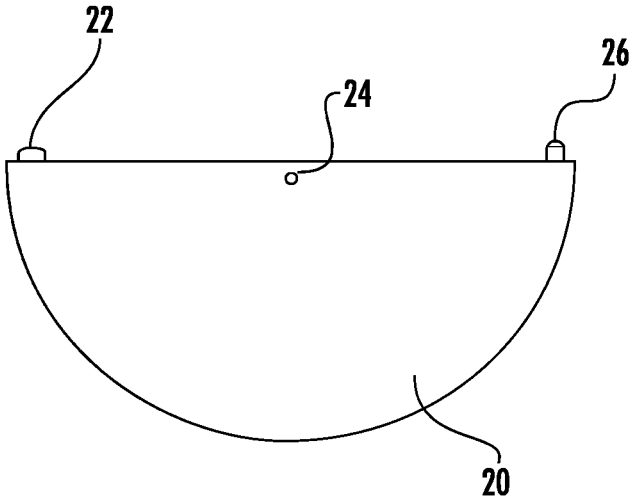
Figure 7A:
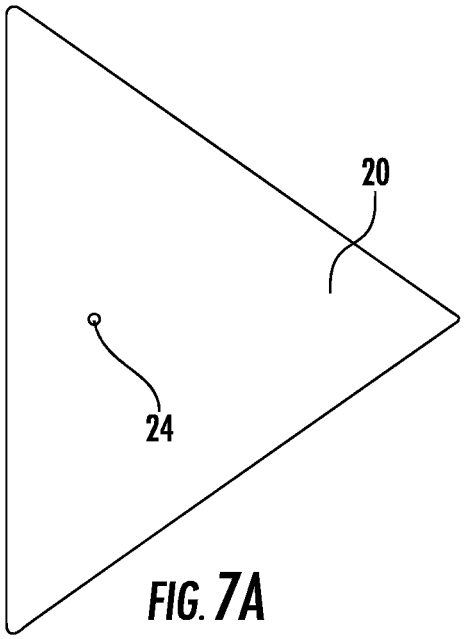
FIGS. 7A-7C are plan views and a perspective view respectively of a rating label plate according to an exemplary embodiment of the invention.
Figure 7B:
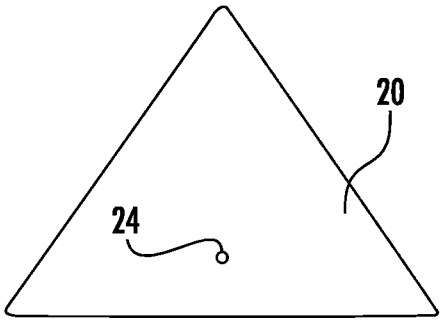
Figure 7C:
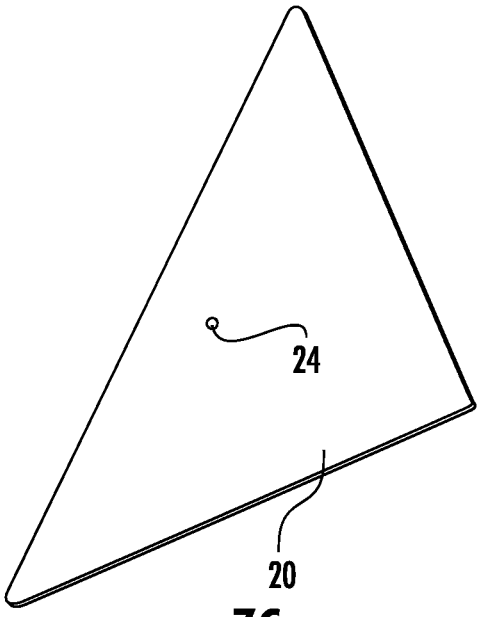

The exemplary pull tabs 22 can be configured to provide one or more additional or alternative functions. For example, the pull tab 22 of the rating label plate 20 can prevent the plate 20 from over-rotating alongside the housing, or over-rotating into the cavity 14, in the housing where the rating label plate 20 may not be retrieved or at least not easily retrievable by the user. As shown in FIGS. 2B and 2C, only the pull tab 22 and the straight edge 20*a* of the plate 20 may be visible outside of the cavity 14 when the rating label plate 20 is in the closed position.

Additionally or alternatively, the pull tab 22 may have a size and shape that provides a suitable cam surface for contacting an interior surface of the appliance door 8 and transferring forces from the door 8 to the rating label plate 20 to guide or urge the rating label plate 20 into the stored position when the door 8 is moved from an open position to a closed position. For example, the force exerted by the user on the door 8 to close the door 8 can be transmitted to the label plate 20 by the interaction of the pull tab 22 with the interior surface of the appliance door 8 to cause the rating label plate 20 to correspondingly or automatically move into the stored position if the rating label plate 20 is in a deployed or partially deployed state when the door 8 is being closed.

In other exemplary embodiments, the pull tab 22 can include a friction or wear reducing portion, such as a roller or a friction reducing surface. For example, with reference to FIG. 4D, the pull tab 22 optionally can include a friction reducing surface 23 that covers a portion, or all, of a surface of the pull tab 22. The roller or friction reducing surface may be formed from a material such as metal, Teflon, nylon, etc., and/or have a shape (e.g., curved shape, smooth shape, etc.) that functions as a suitable cam surface for contacting an interior surface of the appliance door 8 such that the rating label plate 20 easily is guided or urged by the door 8 into the stored position when the door 8 is moved from an open position to a closed position, for example, with minimal effort, without causing wear, marking, etc., to the surface of the door 8 or rating label plate 20, while also minimizing or preventing a locking up of the rating label plate 20 with the door 8, jamming of the rating label plate 20 against the door 8, etc. The friction reducing portion (e.g., coating 23 shown in dashed lines in FIG. 4D) can be formed from a material having suitable heat resistant, fire resistant, or fire retardant qualities.

The rating label plate 20 can include one or more stop means (not visible in FIGS. 2A-2G; see, e.g., stop tab 26 in FIGS. 3A-6B) for preventing the plate 20 from over-rotating out (away from the appliance) from alongside the housing or out of the cavity 14 of the housing. The exemplary stop tab 26 can have any suitable shape that prevent the plate 20 from over-rotating out (away from the appliance) from alongside the housing or out of the cavity 14 of the housing. For example, the stop tab 26 can extend substantially perpendicular to, or at an angle to, the plane of the rating label plate 20. The stop tab 26 can extend from one or both sides of the rating label plate 20. The stop tab 26 can have a substantially planar shape, a curved, shaped, or a plurality of portions having one or more shapes and/or extending in one of more directions. The stop tab 26 can extend from the same side of the rating label plate 20 as the pull tab 22. Alternatively, the stop tab 26 can extend from an opposite side of the rating label plate 20 as the pull tab 22.

The label plate 20 and/or the stop means 26 of the label plate 20 also can be configured to assist with biasing the label plate 20 in the stored position when the label plate 20 is rotated to or beyond a predetermined point (e.g., approximately or substantially 45%) about the pivot point 24. For example, the location of a pivot point 24 of the label plate 20 and/or a mass of the stop means 26 formed on the rating label plate 20 can be selected such that the label plate 20 can provide a "soft close" function such that, once the label plate 20 is moved about the pivot point 24 to or beyond a predetermined point, the weight of the rating label plate 20 (or the weight of the stop means 26 on the rating label plate 20) causes the rating label plate 20 to continue rotating until the rating label plate 20 arrives at the stored position without further input or force being applied by the user. These features also may reduce or prevent damage or wear resulting from the rating label plate 20 contacting the interior surface of the appliance door, for example, since the rating label plate 20 is stored in a concealed location when the rating label plate is not in use.

Figure 8A:
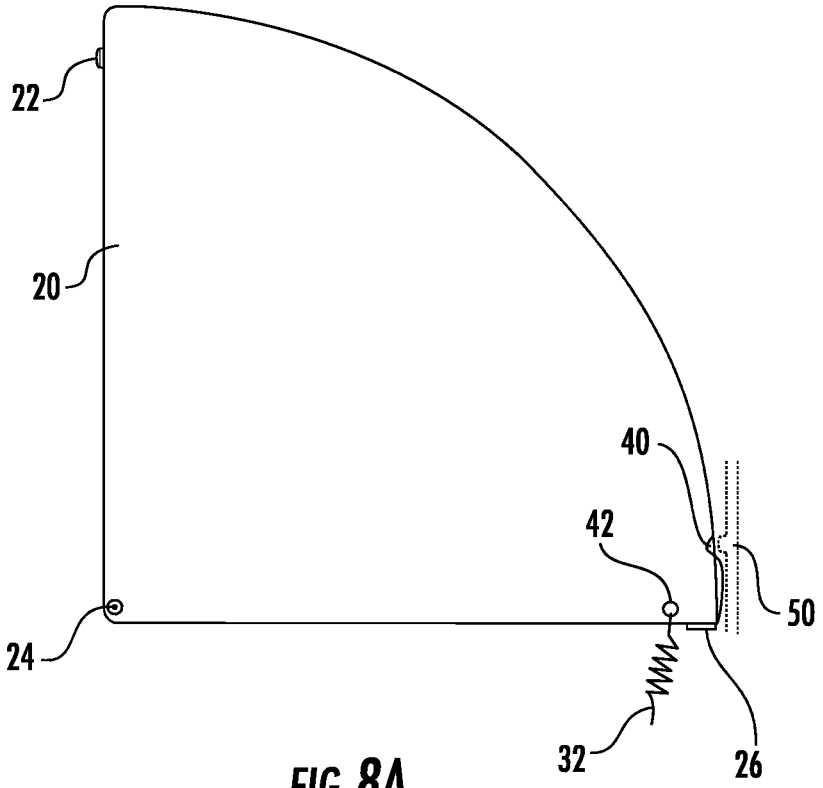
FIGS. 8A-8D are plan views and perspective views respectively of a rating label plate according to an exemplary embodiment of the invention.
Figure 8B:
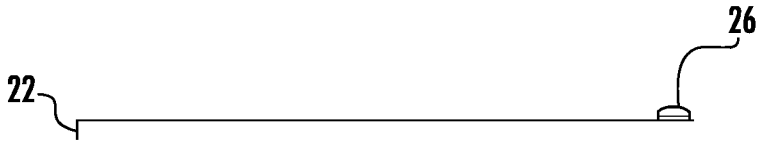
Figure 8C:
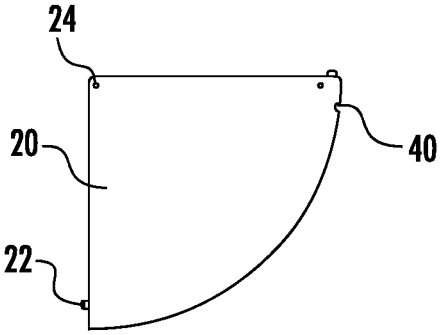
Figure 8D:
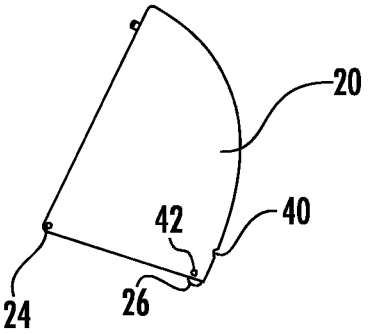

In other exemplary embodiments, biasing means (such as one or more springs 32, as exemplarily illustrated in FIG. 8A) may be provided to provide or assist with the movement of the rating label plate 20 from the closed position to the deployed position or from the deployed position to the closed position.

The rating label plate 20 may include one or more features or parts for receiving or engaging an end of a spring (e.g., 32) coupled at the other end to the housing or another part. The features or parts may be separate parts or integrally formed with the plate 20 and may include, for example, an opening (e.g., 42), through-hole, notch, groove, emboss, or the like formed in a surface of the plate 20, or a projection such as a pin, rod, spindle, shaft, protuberance, or the like extending away from the plate, for receiving or engaging the spring (e.g., 32). In other embodiments, the rating label plate 20 may include one or more detents (e.g., 40) for receiving a portion of one or more spring cam devices or the like (e.g., 50 illustrated in dashed lines in FIG. 8A).

The rating label plate 20 can be movable from an entirely stored position to an entirely deployed position, or in increments in between, such as one or more partially deployed positions. The rating label plate 20 can be configured to stop at one or more of the deployed and/or partially deployed positions. For example, the rating label plate 20 can include one or more detents 40 for receiving one or more spring cam devices 50 or the like on the housing or another part for temporarily stopping or suspending the rating label plate at one or more of the deployed and/or partially deployed positions. In other embodiments, an incremental hinge device or ratchet device (not shown) may be provided for temporarily stopping or suspending the rating label plate 20 at one or more of the deployed and/or partially deployed positions.

The pivot point 24 of the label plate 20 may be above the pivot point of the door 8 (e.g., door hinge point) to facilitate contact of the pull tab 22 with an interior surface of the door 8 when the door 8 is being closed, and thus, cause the label plate 20 to rotate into the closed position. The location of the pivot point 24 of the label plate 20 may reduce or prevent jamming of the label plate against the door 8 of the appliance. In other embodiments, the rating label plate 20 can include biasing means for biasing the rating label plate into the closed position, such as one or more springs (e.g., a spring 32 in FIG. 8A) biasing the rating label plate 20 in the closed position.

Figure 9A:
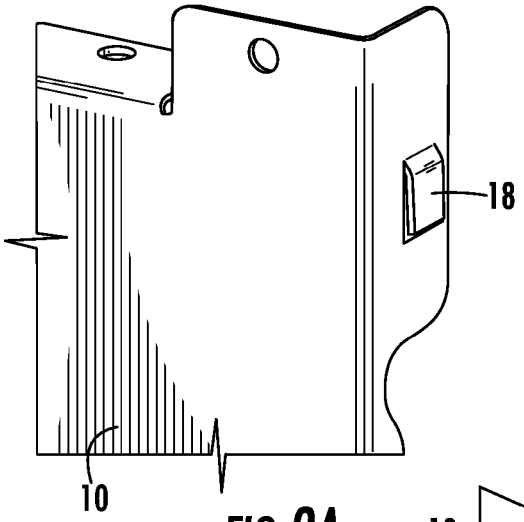
FIGS. 9A-9C are partial perspective views of an appliance housing having a tab or guide for guiding the rating label plate, according to an exemplary embodiment of the invention.
Figure 9B:
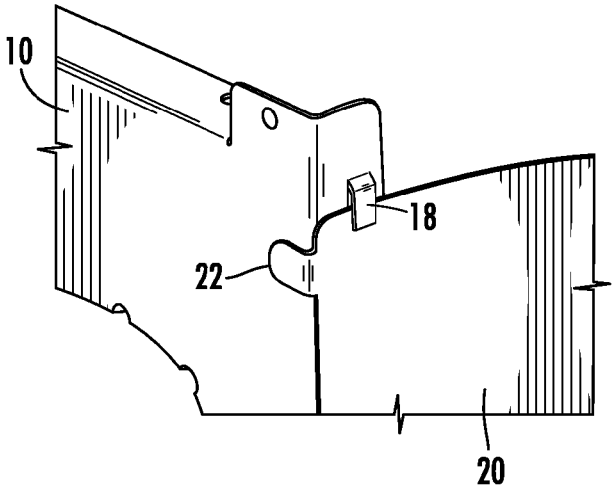
Figure 9C:
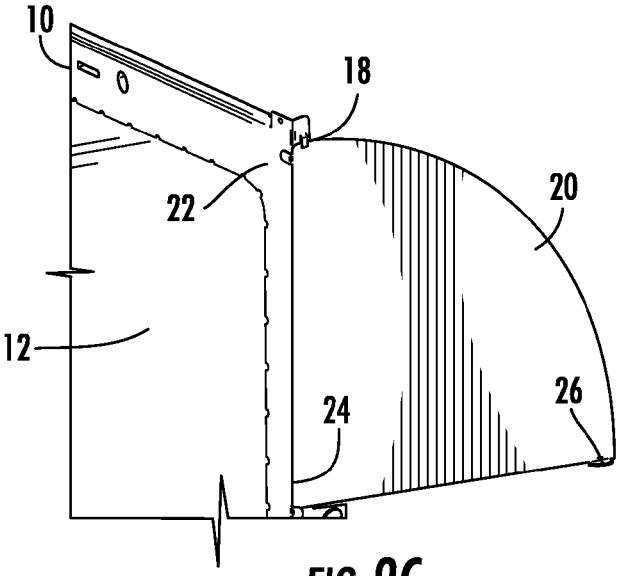

With reference to the exemplary embodiment of FIGS. 9A-9C, the housing of the appliance can include a tab or guide portion 18 that guides the rating label plate 20 during movement between the stored position and deployed position and/or that stabilizes the rating label plate 20 in the stored or deployed position. For example, the housing can include a tab 18 projecting from a surface that is adjacent to the rating label plate 20 such that a portion or edge (e.g., 20*b*) of the rating label plate 20 is disposed between the tab 18 and a surface of the housing during movement of the plate 20 between the stored position and deployed position and/or that stabilizes the rating label plate 20 in the stored or deployed position. In other embodiments, the tab or guide 18 can include a projection such as a pin, follower, raised portion, protuberance, or the like formed on the rating label plate 20 or the housing, respectively, and a corresponding slot, cam surface, emboss, recessed portion, or the like formed on the other of the rating label plate 20 or housing, respectively.

In other exemplary embodiments, a portion of the tab or guide 18 and/or a portion of the rating label plate 20 can include a friction or wear reducing portion, such as a roller and friction reducing surface. The roller or friction reducing surface may be formed from a material such as metal, Teflon, nylon, etc., and/or have a shape (e.g., curved shape, smooth shape, etc.) such that the rating label plate 20 can be easily and smoothly guided while moving between the stored position and deployed position. The friction reducing portion can be formed from a material having suitable heat resistant, fire resistant, or fire retardant qualities.

A portion of the tab or guide 18, the housing, and/or a portion of the rating label plate 20 can include a seat or the like such that a portion of the rating label plate 20 is seated and/or provides a user with a tactile seating of the rating label plate 20 when the plate 20 is in the stored position. The seat or the like can include one or more resilient portions, flexible portions, corresponding engaging portions, etc. that facilitate the seating or tactile seating of the plate 20 with respect to the tab or guide 18, the housing, etc.

In the exemplary embodiments illustrated in FIGS. 2A-2G, for example, the rating label plate is illustrated as having an approximately or substantially quarter-circle shape. However, one of ordinary skill in the art will recognize that the rating label plate 20 can have other shapes, sizes, and arrangements. For example, the rating label plate 20 can have a circular, oval, half-circle, or quarter-circle shape to facilitate easy rotation and deployment and storage. In other embodiments, the rating label plate 20 can be rectangular or square (see, e.g., FIGS. 10A-10C) or triangular (see, e.g., FIGS. 7A-7C). In still other embodiments, the rating label plate 20 can have an irregular or amorphous shape. Other shapes, sizes, and configurations of rating label plates 20 also are contemplated within the spirit and scope of the invention. The rating label plate 20 can be rotatable, pivotable, or linearly translatable or slidable between the stored position and the deployed position.

Figure 11A:
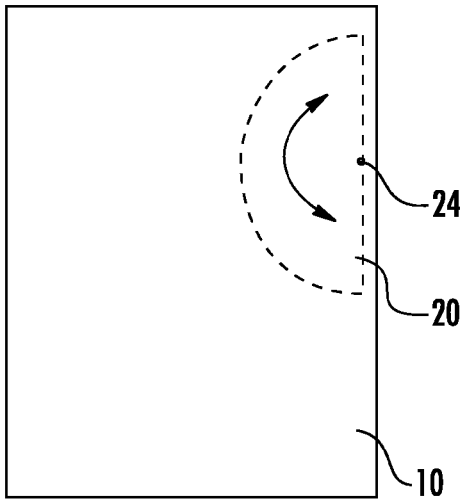
FIGS. 11A and 11B are partial plan views of an appliance and rating label plate according to an exemplary embodiment of the invention.
Figure 11B:
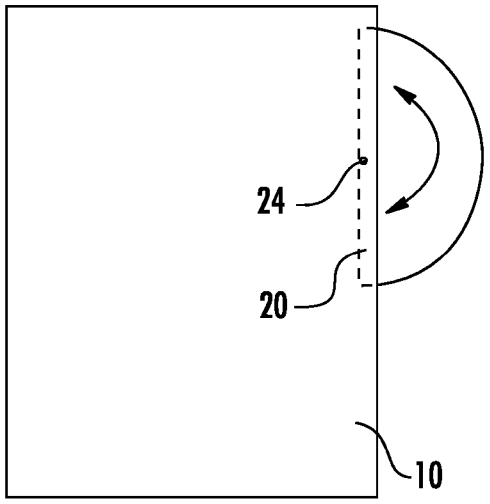

With reference to FIGS. 11A and 11B, the rating label plate 20 can be formed from a half-circle shaped plate that rotates about a pivot point 24 disposed along about a middle portion of a flat edge 20*b* of the plate 20. In this exemplary embodiment, the rating label plate 20 can rotate approximately 180 degrees from the closed (or stored) position to the open (or deployed) position to deploy the rating label plate outside of the cavity 14.

Figure 12A:
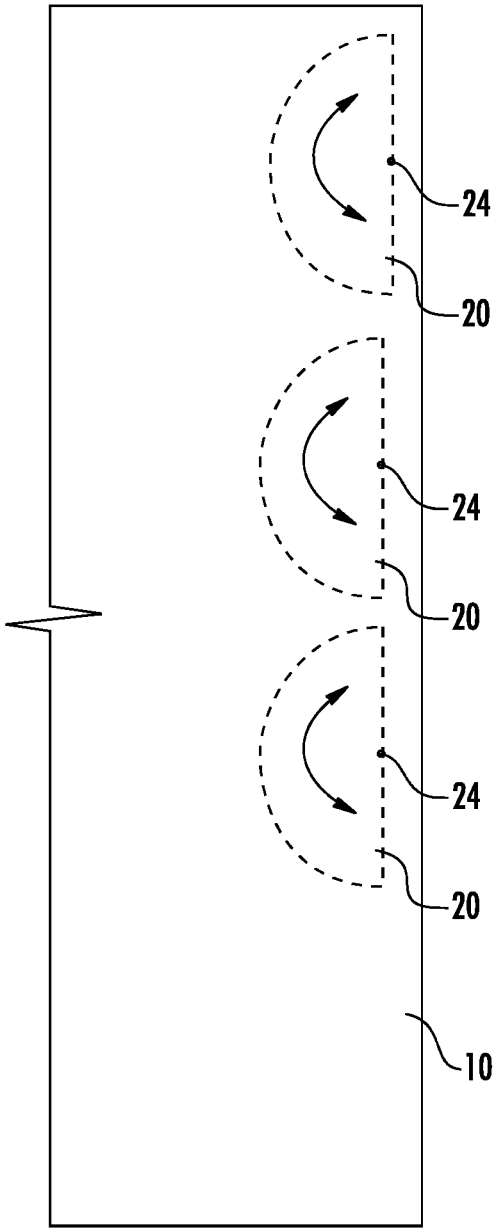
FIGS. 12A and 12B are partial plan views of an appliance having a plurality of rating label plates according to an exemplary embodiment of the invention.
Figure 12B:
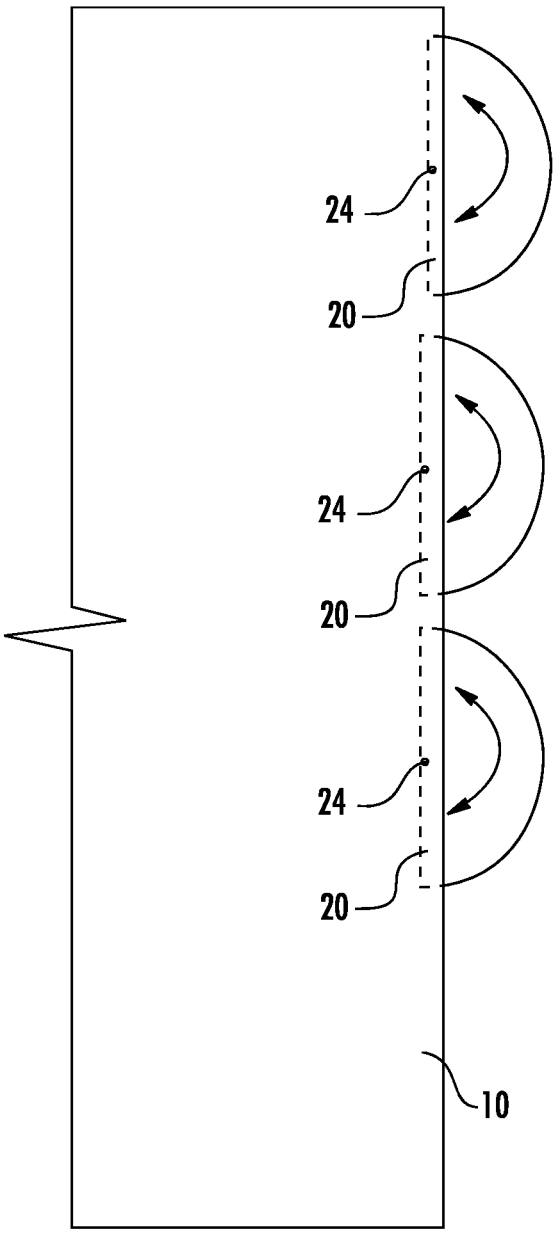
Figure 13A:
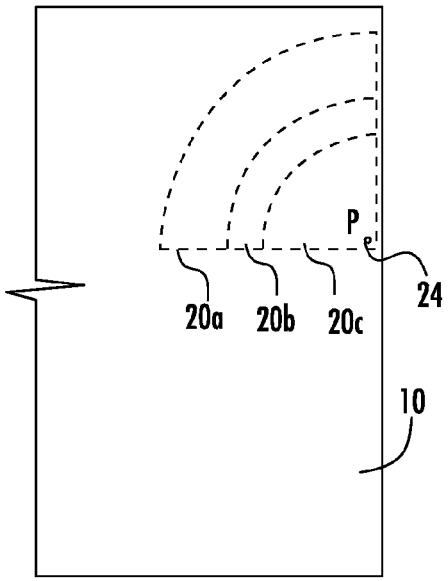
FIGS. 13A and 13B are partial side views of an appliance having a plurality of rating label plates.
Figure 13B:
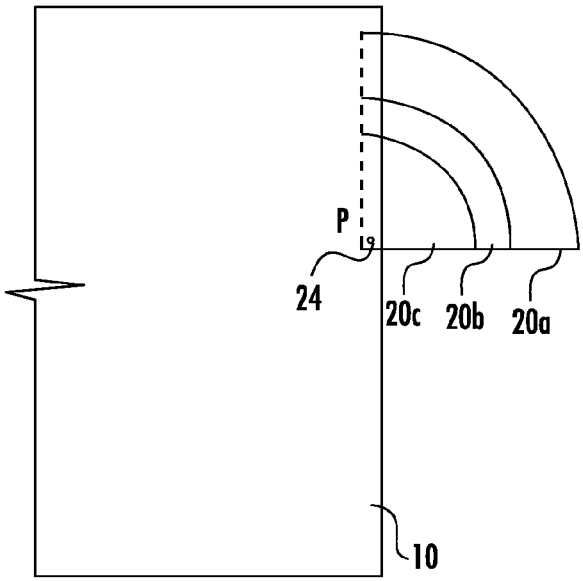
Figure 13C:
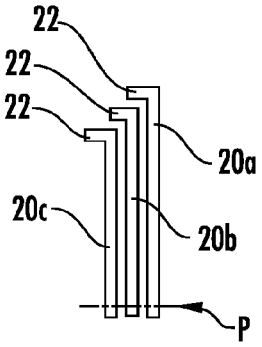
FIGS. 13C and 13D are partial schematic views of a plurality of stored or nested rating label plates, according to exemplary embodiments of the invention.
Figure 13D:
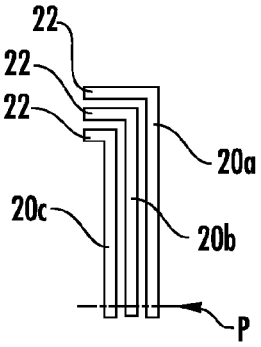
Figure 14A:
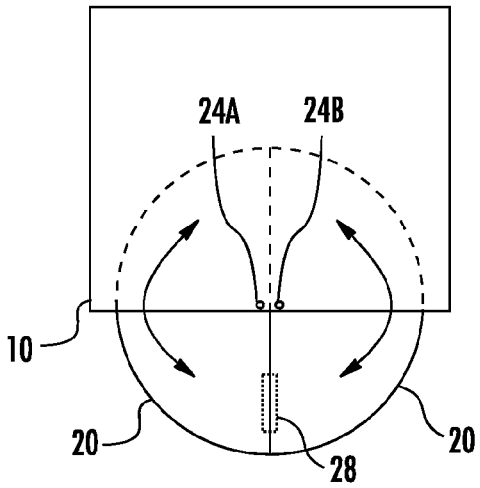
FIGS. 14A-14C are a top view and front views respectively of an appliance and rating label plate according to an exemplary embodiment of the invention.
Figure 14B:
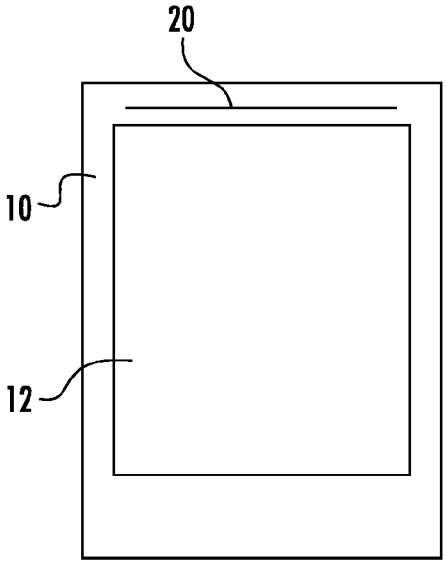
Figure 14C:
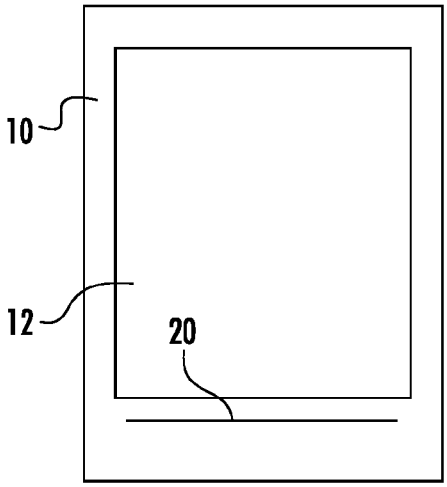

With reference to FIGS. 12A-12B and 13A-13C, the rating label plate 20 can be formed from a plurality of rating label plates 20. For example, as shown in FIGS. 12A-12B, a plurality of rating label plates 20 can be configured in series along a surface of the housing. In this exemplary embodiment, the rating label plates 20 may be smaller than the rating label plate 20 illustrated, for example, in FIGS. 2A-2G, while providing a similar or the same amount of surface area for the rating labels by virtue of the multiple rating label plates.

As shown in FIGS. 13A-13D, the rating label plate 20 can include a plurality of rating label plates (e.g., 20*a*, 20*b*, 20*c*) that are configured, for example, in a nested position with respect to each other in the stored position and fan out from the stored position to the deployed position. One or more of the rating label plates 20 may have the same size and/or shape or a different size or shape. In the exemplary embodiments illustrate din FIGS. 13A-13D, each successive plate is smaller than an adjacent plate such that the plurality of rating label plates can be nested with respect to each other. The pull tabs 22 of each plate may be disposed at different positions along an edge of each plate, staggered, or have different sizes and/or shapes, etc. to permit the user to easily select and grasp any single one of the pull tabs 22 (or all of the pull tabs 22) when the rating label plates 20 are in a stored position.

Accordingly, the exemplary embodiments can comply with the applicable appliance standards as tested and evaluated by Third Party Testing and Listing Agencies, while minimizing visibility of the labels to a user, which may be desirable to marketing, sales, kitchen/home designers and customers. A rotating plate, such as a rotating stainless steel plate, can be provided that rotates about a pivot point (hides) along side or adjacent to the housing of the appliance, or within a cavity in the housing of the appliance.

One of ordinary skill in the art will recognize that other rating label plate arrangements are possible and the exemplary embodiments are not limited to the illustrated arrangements.

For example, with reference again to FIGS. 1A-1C, in other exemplary embodiments, one or more rating label plates 20 can be stored in other parts of the appliance 2 depending on the particular appliance. For example, in a cooking appliance, such as an range shown in the example illustrated in FIGS. 1A-1C, a rating label plate 20 can be stored at a position (A) alongside an exterior side of the housing, in a location (e.g., a pocket, for example, at position B) in a side of the housing, in a location in the housing that is hidden by the door 8 when the door 8 is closed (e.g., a surface surrounding the opening 12 to the cooking chamber, such as a surface 10 alongside, above, or below the opening 12 to the cooking chamber) (e.g., at positions B, C, D), behind a removable kick panel or access panel (e.g., at positions D, G), in a side or top surface of a door 8, 8*a*, 8*b* (e.g., at positions A, B, C), in a drawer such as a warming drawer 8*c* in FIG. 1B (e.g., at position G), in one or more feet of the appliance (e.g., at positions K), in a surface of a control panel of the appliance (e.g., at positions E, F), in a top surface or edge of a top surface of the appliance (e.g., at positions E, J), in a surface of a backsplash or backsplash/shelf of the appliance (e.g., at positions H, I), etc., among other locations.

As illustrated in the exemplary embodiment of FIGS. 2A-2G, the rating label plate 20 can be disposed in a vertical position with respect to the appliance such that the rating label plate 20 rotates out and downward from the stored position to the deployed position. However, in other embodiments, such as the exemplary embodiment illustrated in FIGS. 14A-14C, the rating label plate 20 can be disposed in a horizontal position with respect to the appliance such that the rating label plate 20 rotates out from the appliance in a substantially horizontal plane from the stored position to the deployed position. For example, as show in FIGS. 14B and 14C respectively, the rating label plate 20 can be disposed in a cavity 14 formed in the front surface of 10 of the edge above or below the opening 12 of the appliance. The rating label plate 20 can be formed from a plurality of rating label plates 20, such as a plurality of quarter-circle rating label plates that join together to form a single rating level plate and are secured together by a clamp 28 or other securing means.

For example, a first plate and a second plate can be movable about the same pivot point or a different pivot point between, for example, an angle of 0 degrees and 90 degrees, such that an edge of the first plate is disposed directly adjacent to, or abuts directly against, an edge of the second plate when the first plate and the second plate each are in the deployed position. A securing device (e.g., clamp 28) can be provided on one of the first plate and the second plate to secure the first plate and the second plate together in the deployed position, thereby providing a larger rating label surface.

In other exemplary embodiments, the rating label plate 20 can be disposed in a vertical position with respect to the appliance such that the rating label plate rotates out and upward from the stored position to the deployed position. One or more biasing means (such as one or more springs (e.g., 32) or detent/spring cam devices (e.g., 40, 50) may be provided to prevent the rating label plate 20 from rotating back into the closed position without being manually held by the user in the deployed/open position.

The exemplary embodiments of the deployable rating label plate 20 can be movable about the pivot point between an angle of 0 degrees and 90 degrees, 0 degrees and 180 degrees, or another range of motion.

In other embodiments, the rating label plate 20 can be disposed in a location that is concealed or hidden by the door (e.g., see FIG. 14C) and in which access to the rating label plate 20 is obstructed by the door 8 when the door 8 is in the open or closed position, since many cooking appliance doors can be easily and readily removed without tools, thereby complying with the applicable standards for being "readily accessible."

Figure 15A:
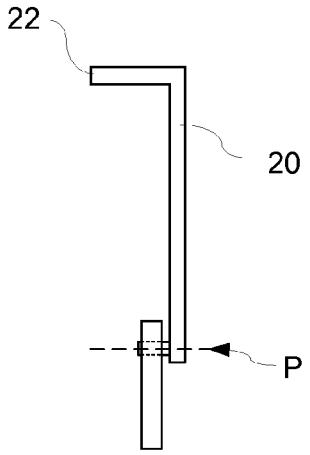
FIGS. 15A and 15B are partial side views of an appliance having a rating label plate according to exemplary embodiments of the invention.
Figure 15B:
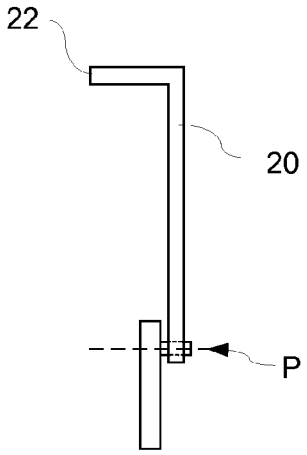

The rating label plate 20 can be pivotally-deployable from one or more sides of the housing. The rating label plate 20 is not limited to the illustrated embodiments and can include other shapes and sizes. The pivot points 24 can be formed, for example, by a hinge, a projection such as a pin, rod, shaft, spindle, axle, etc. that permits the rating label plate 20 to rotate or pivot from a stored position along-side or within a cavity 14 of gap of the housing to a deployed position outside of the cavity of the housing. For example, as shown in FIGS. 15A and 15B, one of the housing and the deployable rating label plate can include a projection at a location of the pivot point, and another of the housing and the deployable rating label plate can include a corresponding projection opening that engages the projection to rotatably support the deployable rating label plate on the housing at the pivot point. The rating label plate 20 also can be deployable in steps or increments along the path of movement to provide a user with the option of fully or partially deploying the plate, for example, to expose all or only a portion of the rating label surface 30.

In other embodiments, for example as shown in FIGS. 10A-10C, the rating label plate 20 can translate or slide alongside or adjacent to the housing of the appliance, or into a cavity 14 in the housing of the appliance in a direction perpendicular to a front face (e.g., 10) of the appliance. The rating label plate 20 can include one or more grooves or projections 44 (e.g., embosses) to facilitate sliding of the rating label plate 20 with respect to the housing or the interior surface of the cavity 14 of the housing, or to guide the rating label plate 20 throughout the movement from the stored position to the deployed position. The housing can include one or more corresponding features, such as tracks, guides, projections, etc., for engaging the rating label plate 20 and guiding the rating label plate 20 into and out of the cavity 14.

The present invention has been described herein in terms of several preferred embodiments. However, modifications and additions to these embodiments will become apparent to those of ordinary skill in the art upon a reading of the foregoing description. Like numbers refer to like elements throughout. In the Figures, the thickness of certain lines, layers, components, elements or features may be exaggerated for clarity.

The appliance having the rating label plate is not limited to the exemplary household cooking appliances described herein, and can include various other appliances that may require or benefit from deployable rating label plates or information plates, such as portable cooking appliances, small or portable kitchen appliances, electronic devices such as printers, copiers, etc., HVAC appliances, lighting fixtures, etc.

What is claimed is:

1. A home appliance comprising:

a housing having a first opening for accessing an interior compartment of the housing;

a door movable for accessing or closing the first opening of the housing; and a deployable rating label plate having a label surface including a rating label, the deployable rating label plate being coupled to the housing outside the interior compartment of the housing and one of:

alongside the housing; and in a cavity formed in the housing and accessible through a second opening in a surface of the housing, wherein the deployable rating label plate is movable between a first position in which the label surface of the rating label plate is hidden from view by the housing and a second position in which the label surface of the rating label plate is exposed and visible to a user, wherein the deployable rating label plate is independently movable between the first position and the second position when the door is in an open position, and wherein the rating label plate includes a thin metal plate having two planar sides opposite each other, and wherein a first planar side of the two planar sides forms the label surface having the rating label and a second side of the two planar sides is configured to receive an additional rating label.

2. The home appliance of claim 1, wherein the deployable rating label plate is supported by the housing at a pivot point, and wherein the deployable rating label plate is a rotatable rating label plate that rotates about the pivot point between the first position and the second position.

3. The home appliance of claim 2, wherein one of the housing and the deployable rating label plate includes a projection at a location of the pivot point, and wherein another of the housing and the deployable rating label plate includes a corresponding projection opening that engages the projection to rotatably support the deployable rating label plate on the housing at the pivot point.

4. The home appliance of claim 2, further comprising biasing means for biasing the deployable rating label plate about the pivot point in a direction of movement from the second position to the first position such that the deployable rating label plate automatically moves into the first position when a rotation position of the deployable rating label plate is equal to or greater than a predetermined rotation position in the direction of movement from the second position to the first position to provide an automatic soft-closure mechanism.

5. The home appliance of claim 4, wherein the biasing means includes the pivot point of the deployable rating label plate being disposed at a predetermined position in which a first mass of a first portion of the deployable rating label plate on a first side of the pivot point exceeds a second mass of a second portion of the deployable rating label plate on a second side of the pivot point when the deployable rating label plate is at the predetermined rotation position about the pivot point such that the deployable rating label plate is biased in the direction of movement from the second position to the first position and thereby automatically moves due to gravity into the first position when the rotation position of the deployable rating label plate is equal to or greater than the predetermined rotation position in the direction of movement from the second position to the first position to provide the automatic soft-closure mechanism.

6. The home appliance of claim 4, wherein the biasing means includes a spring coupled to the deployable rating label plate and biasing a movement of the deployable rating label plate in the direction of movement from the second position to the first position to provide the automatic soft-closure mechanism.

7. The home appliance of claim 6, wherein the deployable rating label plate includes a spring attachment part that receives a portion of the spring.

8. The home appliance of claim 2, wherein the deployable rating label plate is movable about the pivot point between an angle of 0 degrees and 90 degrees.

9. The home appliance of claim 2, wherein the deployable rating label plate is movable about the pivot point between an angle of 0 degrees and 180 degrees.

10. The home appliance of claim 1, wherein the deployable rating label plate is supported by the housing such that the deployable rating label plate is translatable linearly in a plane between the first position and the second position.

11. The home appliance of claim 1, wherein when the housing includes the cavity accessible through the second opening in the surface of the housing, the deployable rating label plate is disposed in the cavity in the first position such that the label surface of the rating label plate is hidden from view from a front of the housing by the housing, and a portion of the deployable rating label plate being disposed outside the cavity in the second position in which the label surface of the rating label plate is exposed and visible to a user from the front of the housing.

12. The home appliance of claim 11, wherein the cavity is formed in a front face of the housing adjacent to the first opening of the housing.

13. The home appliance of claim 11, wherein the cavity is formed in a top face of the housing.

14. The home appliance of claim 11, wherein the cavity is formed in a side face of the housing.

15. The home appliance of claim 11, wherein the cavity is formed in a surface of a backsplash of the housing.

16. The home appliance of claim 11, wherein the cavity is formed in a surface of a support of the housing.

17. The home appliance of claim 11, wherein the cavity and the rating label plate are concealed from view by a portion of the appliance door when the door is in a closed position on the housing.

18. The home appliance of claim 1, wherein the deployable rating label plate includes a first stop portion that limits a range of motion of the deployable rating label plate during movement in an inward direction from the second position to the first position.

19. The home appliance of claim 18, wherein the deployable rating label plate includes a second stop portion that limits a range of motion of the deployable rating label plate during movement in an outward direction from the first position to the second position.

20. The home appliance of claim 1, wherein the deployable rating label plate includes first stop means for limiting a range of motion of the deployable rating label plate during movement in an inward direction from the second position to the first position and for preventing the deployable rating label plate from moving to an interior position that is one of alongside the housing and in the cavity formed in the housing where the rating label plate is not retrievable by the user when the deployable rating label plate is moved in the inward direction from the second position to the first position.

21. The home appliance of claim 20, wherein the deployable rating label plate includes second stop means for limiting a range of motion of the deployable rating label plate during movement in an outward direction from the first position to the second position.

22. The home appliance of claim 1, wherein the deployable rating label plate includes a stop portion that limits a range of motion of the deployable rating label plate during movement in an outward direction from the first position to the second position.

23. The home appliance of claim 1, wherein the deployable rating label plate includes stop means for limiting a range of motion of the deployable rating label plate during movement in an outward direction from the first position to the second position.

24. The home appliance of claim 1, further comprising biasing means for biasing the deployable rating label plate in a direction of movement from the second position to the first position such that the deployable rating label plate automatically moves into the first position when a movement position of the deployable rating label plate is equal to or greater than a predetermined movement position in the direction of movement from the second position to the first position to provide an automatic soft-closure mechanism.

25. The home appliance of claim 1, wherein one of the deployable rating label plate and the housing includes a surface or edge having a detent, and wherein another of the deployable rating label plate and the housing includes a spring cam device that engages the detent when the deployable rating label plate is in a predetermined position.

26. The home appliance of claim 1, wherein one of the deployable rating label plate and the housing includes a surface or edge having a plurality of detents, and wherein another of the deployable rating label plate and the housing includes a spring cam device configured to respectively engage a first detent of the plurality of detents when the deployable rating label plate is in a predetermined position.

27. The home appliance of claim 1, wherein the deployable rating label plate is movable incrementally between a plurality of predetermined positions between the first position and the second position.

28. The home appliance of claim 1, wherein the housing includes a guide portion that guides the deployable rating label plate during movement between the first position and the second position.

29. The home appliance of claim 28, wherein the guide portion includes a tab projecting from a surface of the housing that is adjacent to the deployable rating label plate such that a portion of the deployable rating label plate is disposed between the tab and the surface of the housing one of during movement between the first position and the second position and when the deployable rating label plate is in the first position.

30. The home appliance of claim 28, wherein the guide portion includes a first guide part on the housing and a second guide part on the deployable rating label plate, the first guide part interacting with the second guide part to guide a portion of the deployable rating label plate one of during movement between the first position and the second position and when the deployable rating label plate is in the first position.

31. The home appliance of claim 28, wherein a portion of the guide portion includes a friction reducing portion.

32. The home appliance of claim 28, wherein one of the deployable rating label plate and the housing includes a seat device that engages another of the deployable rating label plate and the housing to provide a user with a tactile seating of the deployable rating label plate in the first position.

33. The home appliance of claim 1, wherein the deployable rating label plate includes a plurality of deployable rating label plates.

34. The home appliance of claim 33, wherein the deployable rating label plate includes a plurality of rotatably deployable rating label plates supported by the housing, wherein each of the plurality of rotatably deployable rating label plates rotates about a pivot point between the first position and the second position.

35. The home appliance of claim 34, wherein each of the plurality of rotatably deployable rating label plates is rotatable about a same pivot point.

36. The home appliance of claim 35, wherein the plurality of rotatably deployable rating label plates are in a nested arrangement in the first position.

37. The home appliance of claim 35, wherein the plurality of rotatably deployable rating label plates are movable to fan out about same pivot point when moving from the first position to the second position.

38. The home appliance of claim 34, wherein each of the plurality of rotatably deployable rating label plates is rotatable about a different pivot point.

39. The home appliance of claim 34, wherein each of the plurality of rotatably deployable rating label plates has a same size.

40. The home appliance of claim 34, wherein each of the plurality of rotatably deployable rating label plates has a different size.

41. The home appliance of claim 34, wherein a first plate of the plurality of rotatably deployable rating label plates is larger than a second plate of the plurality of rotatably deployable rating label plates.

42. The home appliance of claim 34, wherein a first plate of the plurality of rotatably deployable rating label plates is separately rotatable from a second plate of the plurality of rotatably deployable rating label plates.

43. The home appliance of claim 33, wherein each of the deployable rating label plates includes:

a first edge that is substantially flush with an outer surface of the housing when the deployable rating label plate is in the first position; and a pull tab projecting from the first edge, wherein a first pull tab of a first plate of the deployable rating label plates is at a different location along a length of the first edge than a second pull tab of a second plate of the deployable rating label plates.

44. The home appliance of claim 1, wherein the label surface is a planar surface.

45. The home appliance of claim 44, wherein the planar surface has one of a quarter-circle shape and a half-circle shape.

46. The home appliance of claim 44, wherein the planar surface has one of a rectangular shape, a square shape, and a triangular shape.

47. The home appliance of claim 1, wherein the rating label is coupled to the label surface.

48. The home appliance of claim 1, wherein the rating label is one of etched and engraved in the label surface.

49. The home appliance of claim 1, wherein the deployable rating label plate includes a first edge that is flush with an outer surface of the housing when the deployable rating label plate is in the first position.

50. The home appliance of claim 1, wherein the deployable rating label plate is movable in a substantially horizontal plane when moving between the first position and the second position.

51. The home appliance of claim 1, wherein the deployable rating label plate includes a first plate and a second plate, each of the first plate and the second plate being movable about a pivot point between an angle of 0 degrees and 90 degrees, an edge of the first plate being directly adjacent to an edge of the second plate when the first plate and the second plate each are in the second position, the appliance further comprising:

a securing device on one of the first plate and the second plate that secures the first plate and the second plate in the second position.

52. The home appliance of claim 1, wherein the appliance is a domestic household appliance.

53. The home appliance of claim 1, wherein the appliance is a domestic household kitchen appliance.

54. The home appliance of claim 1, further comprising:

a control panel, wherein the deployable rating label plate is independently movable with respect to the control panel.

55. The home appliance of claim 54, wherein the control panel is arranged to be stationary with respect to the housing, and wherein the deployable rating label plate is independently movable with respect to the housing.

56. The home appliance of claim 1, wherein the two planar sides of the thin metal plate are parallel to a side wall of the interior compartment, and the thin metal plate is independently moveable between the first position and the second position in a plane that is parallel to the side wall of the interior compartment.

57. A home appliance comprising:

a housing having a first opening for accessing an interior compartment of the housing;

a door movable for accessing or closing the first opening of the housing; and a deployable rating label plate having a label surface, the deployable rating label plate being coupled to the housing outside the interior compartment of the housing and one of:

alongside the housing; and in a cavity formed in the housing and accessible through a second opening in a surface of the housing, wherein the deployable rating label plate is movable between a first position in which the label surface of the rating label plate is hidden from view by the housing and a second position in which the label surface of the rating label plate is exposed and visible to a user, wherein the deployable rating label plate is independently movable between the first position and the second position when the door is in an open position, wherein when the housing includes the cavity accessible through the second opening in the surface of the housing, the deployable rating label plate is disposed in the cavity in the first position such that the label surface of the rating label plate is hidden from view by the housing, and a portion of the deployable rating label plate being disposed outside the cavity in the second position in which the label surface of the rating label plate is exposed and visible to a user, and wherein the cavity is concealed from view by a portion of the appliance door when the door is in a closed position on the housing.

58. A home appliance comprising:

a housing having a first opening for accessing an interior compartment of the housing;

a door movable for accessing or closing the first opening of the housing; and a deployable rating label plate having a label surface including a rating label, the deployable rating label plate being coupled to the housing outside the interior compartment of the housing and one of:

alongside the housing; and in a cavity formed in the housing and accessible through a second opening in a surface of the housing, wherein the deployable rating label plate is movable between a first position in which the label surface of the rating label plate is hidden from view by the housing and a second position in which the label surface of the rating label plate is exposed and visible to a user, wherein the deployable rating label plate is independently movable between the first position and the second position when the door is in an open position, and wherein the deployable rating label plate includes a pull tab to assist a user with deploying the rating label plate from the first position to the second position, wherein the pull tab is disposed between the housing and the door when the door is in a closed position with respect to the first opening of the housing.

59. The home appliance of claim 58, wherein the pull tab includes a first stop portion that prevents the deployable rating label plate from over-rotating alongside the housing or over-rotating into the cavity in the housing to an interior position where the rating label plate is not retrievable by a user when the deployable rating label plate is moved in an inward direction from the second position to the first position.

60. The home appliance of claim 59, wherein the deployable rating label plate includes a second stop portion that limits a range of motion of the deployable rating label plate during movement in an outward direction from the first position to the second position.

61. The home appliance of claim 58, wherein the pull tab includes a cam surface that contacts an interior surface of the door when the deployable rating label plate is in the second position, the cam surface transferring forces from the door to the deployable rating label plate to guide the deployable rating label plate into the first position when the door is moved from an open position to a closed position.

62. The home appliance of claim 58, wherein the pull tab includes a friction reducing part that contacts an interior surface of the door when the deployable rating label plate is in the second position, the friction reducing part transferring forces from the door to the deployable rating label plate to guide the deployable rating label plate into the first position when the door is moved from an open position to a closed position.

63. The home appliance of claim 62, wherein the friction reducing part includes a roller that contacts an interior surface of the door when the deployable rating label plate is in the second position, the roller transferring the forces from the door to the deployable rating label plate and guiding the deployable rating label plate into the first position when the door is moved from the open position to the closed position.

64. The home appliance of claim 62, wherein the friction reducing part includes a friction reducing material on a surface of the pull tab.

65. The home appliance of claim 58, wherein the deployable rating label plate includes a first edge that is substantially flush with an outer surface of the housing when the deployable rating label plate is in the first position, and wherein the pull tab projects from the first edge.

66. The home appliance of claim 65, wherein the pull tab includes:

a first portion projection from the first edge at a first angle; and a second portion projection from the first portion at a second angle, the first angle being different from the second angle.

67. The home appliance of claim 65, wherein the first edge is substantially straight, and wherein the deployable rating label plate includes a second edge adjacent to the first edge, the second edge being a curved edge.

68. The home appliance of claim 65, wherein the first edge is substantially straight, and wherein the deployable rating label plate includes a second edge adjacent to the first edge, the second edge being substantially straight.

69. A home appliance comprising:

a housing having a first opening for accessing an interior compartment of the housing;

a door movable for accessing or closing the first opening of the housing; and a deployable rating label plate having a label surface, the deployable rating label plate being coupled to the housing outside the interior compartment of the housing and one of:

alongside the housing; and in a cavity formed in the housing and accessible through a second opening in a surface of the housing, wherein the deployable rating label plate is movable between a first position in which the label surface of the rating label plate is hidden from view by the housing and a second position in which the label surface of the rating label plate is exposed and visible to a user, wherein the deployable rating label plate is independently movable between the first position and the second position when the door is in an open position, and wherein the deployable rating label plate is movable in a substantially vertical plane when moving between the first position and the second position.

70. The home appliance of claim 69, wherein the deployable rating label plate is supported by the housing at a pivot point, wherein the deployable rating label plate is a rotatable rating label plate that rotates about the pivot point between the first position and the second position, the home appliance further comprising biasing means for biasing the deployable rating label plate about the pivot point in a direction of movement from the second position to the first position such that the deployable rating label plate automatically moves into the first position when a rotation position of the deployable rating label plate is equal to or greater than a predetermined rotation position in the direction of movement from the second position to the first position to provide an automatic soft-closure mechanism, wherein the biasing means includes the pivot point of the deployable rating label plate being disposed at a predetermined position in which a first mass of a first portion of the deployable rating label plate on a first side of the pivot point exceeds a second mass of a second portion of the deployable rating label plate on a second side of the pivot point when the deployable rating label plate is at the predetermined rotation position about the pivot point such that the deployable rating label plate is biased in the direction of movement from the second position to the first position and thereby automatically moves due to gravity into the first position when the rotation position of the deployable rating label plate is equal to or greater than the predetermined rotation position in the direction of movement from the second position to the first position to provide the automatic soft-closure mechanism.

71. A home appliance comprising:

a housing having a first opening for accessing an interior compartment of the housing;

a door movable for accessing or closing the first opening of the housing; and a deployable rating label plate having a label surface including a rating label, the deployable rating label plate being coupled to the housing outside the interior compartment of the housing and one of:

alongside the housing; and in a cavity formed in the housing and accessible through a second opening in a surface of the housing, wherein the deployable rating label plate is movable between a first position in which the label surface of the rating label plate is hidden from view by the housing and a second position in which the label surface of the rating label plate is exposed and visible to a user, wherein the deployable rating label plate is independently movable between the first position and the second position when the door is in an open position, and wherein the deployable rating label plate is a heat shield formed from a thin metal plate having two planar sides, the heat shield being disposed between a side wall of the interior compartment and a side wall of the housing when the deployable rating label plate is in the first position.

* * * * *